US010371484B1

(12) United States Patent
Warren

(10) Patent No.: US 10,371,484 B1
(45) **Date of Patent: *Aug. 6, 2019**

(54) ILLUMINATED SIGHTING SYSTEM

(71) Applicant: Scott M. Warren, Montclair, VA (US)

(72) Inventor: Scott M. Warren, Montclair, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/143,986

(22) Filed: Sep. 27, 2018

Related U.S. Application Data

(60) Continuation of application No. 15/704,359, filed on Sep. 14, 2017, now Pat. No. 10,088,275, which is a division of application No. 15/047,182, filed on Feb. 18, 2016, now abandoned.

(60) Provisional application No. 62/118,940, filed on Feb. 20, 2015.

(51) Int. Cl.

| | |
|---|---|
| ***F41G 1/00*** | (2006.01) |
| ***F41G 1/34*** | (2006.01) |
| ***F41C 33/02*** | (2006.01) |
| ***F41G 1/02*** | (2006.01) |
| ***F41G 11/00*** | (2006.01) |
| ***F41G 1/06*** | (2006.01) |
| ***F41C 3/00*** | (2006.01) |

(52) U.S. Cl.
CPC ..... *F41G 1/345* (2013.01); *F41C 3/00* (2013.01); *F41C 33/02* (2013.01); *F41G 1/02* (2013.01); *F41G 1/06* (2013.01); *F41G 11/00* (2013.01)

(58) Field of Classification Search
CPC ..... F41G 1/027; F41G 1/345
USPC ..... 42/117, 132
See application file for complete search history.

(56) References Cited

U.S. PATENT DOCUMENTS

| | | | |
|---|---|---|---|
| 5,735,070 | A | 4/1998 | Vasquez et al. |
| 6,367,189 | B1 | 4/2002 | Clay |
| 2002/0166278 | A1 | 11/2002 | Carlson |
| 2006/0026886 | A1 | 2/2006 | Doukas |
| 2016/0091281 | A1 | 3/2016 | Gwillim, Jr. |

OTHER PUBLICATIONS

Final Office Action dated May 15, 2017 in U.S. Appl. No. 15/047,182.
Non-Final Office Action dated Jan. 25, 2018 in U.S. Appl. No. 15/704,359.
Non-Final Office Action dated Sep. 22, 2016 in U.S. Appl. No. 15/047,182.
Notice of Allowance dated Jun. 4, 2018 in U.S. Appl. No. 15/704,359.

*Primary Examiner* — J. Woodrow Eldred
(74) *Attorney, Agent, or Firm* — Gilberto M. Villacorta; Kiri Lee Sharon; Foley & Lardner LLP

(57) ABSTRACT

An illuminated sighting system for providing an illumination at a sight of a firearm includes a power source housed within a compartment of the firearm. The sighting system further includes a light source. The system additionally includes a switch which completes a power circuit that provides power from the power source to the light source when activated, and a conduit configured to transmit light from the light source to the sight of the firearm. The sighting system includes a feature to deactivate the light source when the firearm is holstered or in another stored condition.

20 Claims, 14 Drawing Sheets

ILLUMINATED SIGHTING SYSTEM

CROSS-REFERENCE TO RELATED APPLICATIONS

The present application is a continuation of U.S. patent application Ser. No. 15/704,359, filed Sep. 14, 2017, which is a division of and claims the benefit of the priority date of U.S. patent application Ser. No. 15/047,182, filed Feb. 18, 2016, which claims the benefit of the priority date of U.S. Provisional Patent Application Ser. No. 62/118,940, filed on Feb. 20, 2015, the contents of all of which are hereby incorporated by reference in their entireties.

BACKGROUND

The present application relates generally to sighting systems for firearms. More specifically, the present application relates to an improved sighting system for a handgun.

Traditionally, handgun sights have been machined from steel. In general, front sights were machined to a rectangular shape. Front sights were initially 'plain' in appearance, because the surface at which a shooter looked when shooting was smooth in finish. Further, the rear sight was also 'plain' in appearance, with a corresponding rectangular notch that was machined out of the metal forming the gun sight. This notch allowed the front sight to be seen when the shooter presented the handgun and aligned the sights. Conventional sights were modified so that the front and rear sights were serrated with horizontal lines that allowed darkening agents to adhere to the metal. These serrations also aided the shooter in seeing and identifying the front sight more quickly so that the shooter could readily 'acquire' the sight. However, plain and serrated sights do not perform well in certain circumstances, as described further below.

SUMMARY

The present application discloses a method of deploying a handgun. The method includes activating a manual switch affixed to a handgun to complete a power circuit that provides power from a power source to a light source, said light source comprising a portion of an illuminated sighting system for providing illuminating at least a front sight of the handgun; and pointing the handgun at a potential target while maintaining the illuminated front sight in a field of view, said illuminating sighting system further comprising a passive switch that preserves or restores the power circuit when the handgun is deployed and breaks the power circuit when the handgun is not deployed.

The present application also discloses an illuminated sighting system for illuminating at least a front sight of a handgun. The illuminated sighting system comprises a power source housed within a compartment of a handgun, and a light source housed within the same compartment or a different compartment of the handgun. The system further includes a manual switch affixed to the handgun, which completes a power circuit that provides power from the power source to the light source when activated. The system further still includes a conduit configured to transmit light from the light source and provide an illumination of at least a front sight of the handgun. The illuminated portion of the sight faces an operator of the handgun such that the operator, while maintaining the illuminated front sight in a field of view, can aim the handgun at a potential target in a dimly lit, dark, or nighttime environment.

The present application further discloses a component of a handgun. The component includes a compartment housing a light source, and a conduit configured to transmit light from the light source and provide an illumination of at least a front sight positioned at a distal end of a handgun. The component further includes a manual switch accessible from an outer surface of the component, which completes a power circuit that provides power from a power source to the light source when activated. The power source may optionally be accommodated within the compartment. Further, the component includes a passive switch that preserves or restores the power circuit when the handgun is deployed and breaks the power circuit when the handgun is not deployed.

The present application also discloses a supplemental lighting system or lighting module that can be "added-on" to a handgun. This lighting module is adapted for mating with a slide of a semiautomatic pistol. The lighting module comprises one or more compartments containing a power source, a light source and a conduit that is configured to transmit light from the light source and provide an illumination of at least a front sight positioned at a distal end of the lighting module. Also included is a manual switch accessible from an outer surface of the accessory, which completes a power circuit that provides power from the power source to the light source when activated. Further, the lighting module may include an optional passive switch that preserves or restores the power circuit when the handgun is deployed and breaks the power circuit when the handgun is not deployed.

Still another disclosed embodiment relates to a method of modifying a semiautomatic pistol equipped with a slide and front and rear sights. The method includes removing at least the front sight, and affixing a lighting module to a top, distal surface of the slide. The lighting module comprises one or more compartments housing a power source, light source and conduit and further comprising a substitute front sight and manual switch accessible from an outer surface of the lighting module. The manual switch completes a power circuit that provides power from the power source to the light source when activated. The conduit is configured to transmit light from the light source and provide an illumination of the substitute front sight.

The disclosed embodiments may be modified and employed in various ways. For example, various configurations of illuminations are readily apparent, including a front sight having one or more illuminations (e.g., one at the base of the front sight and another at or towards the top of the front sight) and a rear sight having two illuminations (e.g., one for each split post of a rear sight). Alternative exemplary embodiments relate to other features and combinations of features as may be recited in the claims.

BRIEF DESCRIPTION OF THE DRAWINGS

The disclosure will become more fully understood from the following detailed description, taken in conjunction with the accompanying figures, wherein like reference numerals, symbols or terms generally identify similar components, unless context dictates otherwise, and in which.

PREFERRED EMBODIMENTS

Figure 1:
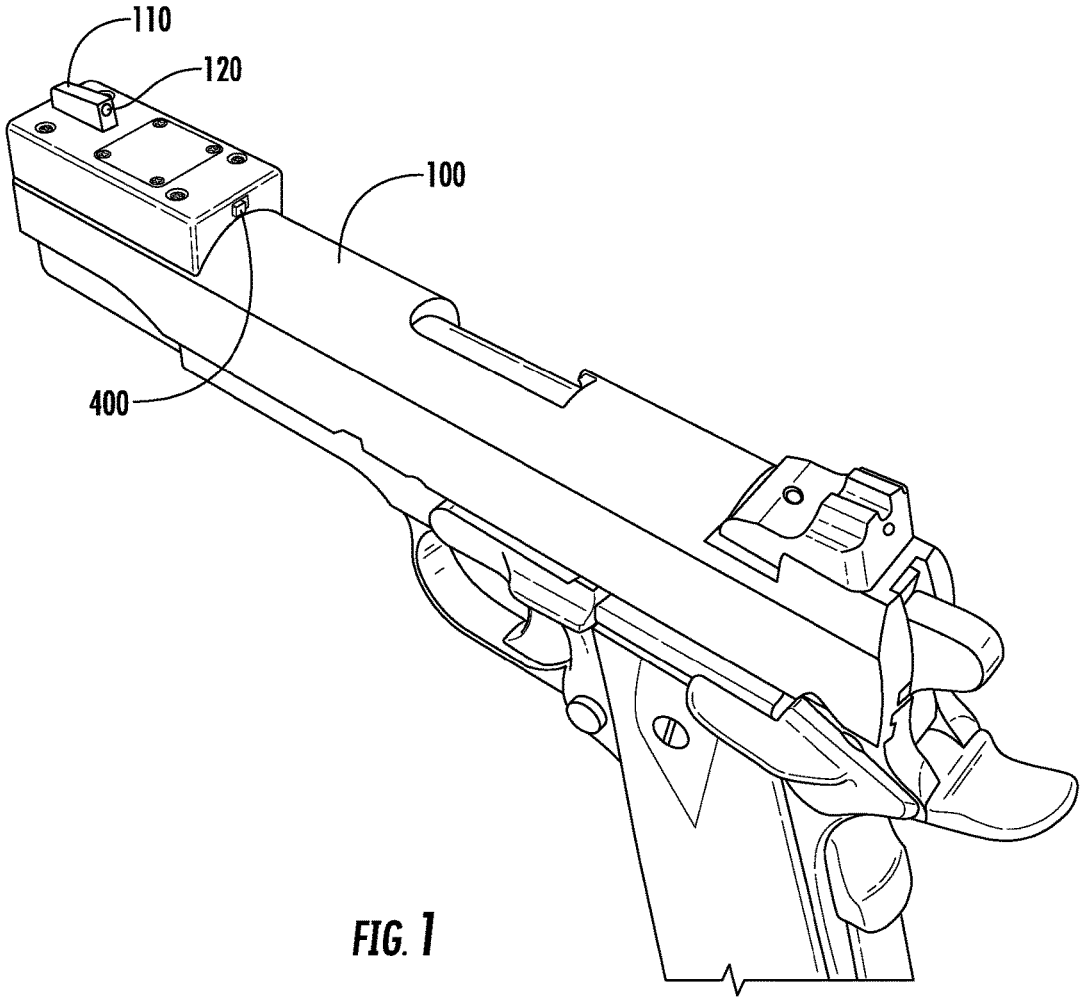
FIG. 1 depicts a perspective view of an illuminating sighting system.

A method of deploying a handgun comprising:

activating a manual switch to complete a power circuit that provides power from a power source to a light source, said light source comprising a portion of an illuminated sighting system for providing at least an illuminated front sight of the handgun; and pointing the handgun at a potential target while maintaining the illuminated front sight in a field of view, said illuminated sighting system further comprising a passive switch that preserves or restores the power circuit when the handgun is deployed and breaks the power circuit when the handgun is not deployed.

A preferred method, which further comprises keeping the handgun holstered after the manual switch is activated, said holster comprising an element that works cooperatively with the passive switch to break the power circuit while the handgun is holstered.

A preferred method, which further comprises withdrawing the handgun from its holster prior to pointing the handgun at a potential target, the element in said holster working cooperatively with the passive switch to restore the power circuit while the handgun is deployed.

A preferred method, in which keeping the handgun holstered includes tucking away the handgun in a piece of clothing in proximity of an element that works cooperatively with the passive switch to break the power circuit while the handgun is tucked away.

A preferred method, in which the piece of clothing comprises a pair of pants or a skirt.

A preferred method, in which the element is sewed or stitched into or onto the piece of clothing or the element comprises a portion of an accessory.

A preferred method, in which the accessory is selected from the group consisting of a pendant, belt, badge, pin, brooch, ankle bracelet, stocking, socks, shoe, boot, wallet and pocketbook.

A method of providing at least one illuminated sight of a firearm comprising:

grasping a firearm in at least one hand;

activating a manual switch affixed to the firearm to complete a power circuit that provides power from a power source to a light source, said light source producing at least one illuminated sight of the firearm via a light transmitting conduit;

allowing an optional passive switch to preserve or restore the power circuit when the firearm is deployed and break the power circuit when the handgun is not deployed.

A preferred method, in which said light source produces an illuminated rear sight of the firearm.

A preferred method, in which the rear sight comprises split posts and the illuminated rear sight includes each of the split posts being illuminated.

An illuminated sighting system for providing at least an illuminated front sight of a handgun comprising:

a power source housed within a compartment of a handgun;

a light source housed within the same compartment or a different compartment of the handgun;

a power circuit that provides power from the power source to the light source;

a conduit configured to transmit light from the light source and provide at least an illuminated front sight of the handgun, the illumination generally directed at an operator of the handgun such that the operator, while maintaining the illuminated front sight in a field of view, can point the handgun at a potential target in a dimly lit, dark, or nighttime environment.

A preferred system, which further comprises a passive switch that preserves or restores the power circuit when the handgun is deployed by the operator and breaks the power circuit when the handgun is not deployed by the operator.

A preferred system, in which the light source produces an illuminated rear sight of the handgun.

A preferred system, in which the rear sight comprises split posts and the illuminated rear sight includes each of the split posts being illuminated.

A preferred system, in which the passive switch comprises a variable transducer configured to vary a voltage.

A preferred system, in which the variable transducer comprises a Hall Effect sensor.

A preferred system, in which the passive switch comprises a Reed switch.

A preferred system, in which the passive switch works cooperatively with an element that is external to the handgun such that the power circuit is broken when the passive switch is proximal to the element and the power circuit is preserved or restored when the passive switch is not proximal to the element.

A preferred system, in which the power source is configured to allow a variation in an intensity of the illumination.

A preferred system, in which the intensity of the illumination can be increased to permit the illumination to be perceived by an operator in a well-lit, bright, or daytime environment.

A preferred system, in which the conduit comprises a fiber optic rod.

A preferred system, in which the compartment housing the power source is positioned above or within a sliding portion of the handgun.

A preferred system, in which the compartment housing the power source is the same compartment housing the light source.

A preferred system, in which the illumination is comprised of three distinct illuminations each having a dimension that is equal to one or both of the others.

A preferred system, in which the illumination is comprised of a front sight illumination and a rear sight illumination, each having a dimension that is equal or unequal to the other.

A preferred system, in which the compartment housing the power source and the light source accommodates the conduit.

A preferred system, in which the handgun is semiautomatic.

A component of a handgun comprising:

a compartment housing a light source and a conduit configured to transmit light from the light source and provide at least an illuminated front sight positioned at a distal end of a handgun;

a manual switch accessible from an outer surface of the component, which completes a power circuit that provides power from a power source to the light source when activated, the power source optionally accommodated within the compartment;

an optional passive switch that preserves or restores the power circuit when the handgun is deployed and breaks the power circuit when the handgun is not deployed.

A preferred component, which further comprises a passive switch that preserves or restores the power circuit when the handgun is deployed and breaks the power circuit when the handgun is not deployed.

A preferred component, in which the at least a front sight is affixed on an outside surface of the component.

A preferred component, in which the illumination is generally directed at an operator of the handgun such that the operator, while maintaining the illuminated front sight in a field of view, can point the handgun at a potential target in a dimly lit, dark, or nighttime environment.

A preferred component, which is configured to operably engage with a remainder of a handgun slide.

A preferred component, in which the component is configured to engage with an upper portion of the remainder, such that the component sits above the remainder.

A preferred component, in which the component is configured to engage with the remainder using at least in part a stabilization member.

A preferred component, in which the stabilization member comprises a rectangular bar positioned orthogonally to the direction of a sliding movement of the handgun slide.

A preferred component, further comprising a storage unit including a substantially circular compartment that houses at least a portion of the power source and a spring mechanism configured to maintain a position of the at least a portion of the power source.

A preferred component, in which the manual switch comprises a pressure plate.

A preferred component, in which the component cooperates with a rail mechanism of the handgun.

A preferred component, in which the power source is positioned within a portion of the handgun that falls below the rail mechanism under conventional use conditions.

A preferred component, in which the handgun is considered not deployed when holstered.

A semiautomatic pistol having a slide, frame, trigger, grip and magazine well and further comprising:

a compartment housing a light source and a conduit configured to transmit light from the light source and provide at least an illuminated front sight positioned at a distal end of the pistol;

a manual switch accessible from an outer surface of the pistol, which completes a power circuit that provides power from a power source to the light source when activated, the power source optionally accommodated within the same compartment that houses the light source and the conduit; and a passive switch that preserves or restores the power circuit when the pistol is deployed and breaks the power circuit when the handgun is not deployed.

A preferred pistol, in which an illuminated rear sight of the handgun is also provided.

A preferred pistol, in which the compartment forms at least a portion of the slide.

A preferred pistol, in which the compartment further houses the power circuit.

A preferred pistol, in which the power circuit comprises one or more printed circuit boards.

A preferred pistol, in which the rear sight includes a notch and the illuminated rear sight comprises at least an illuminated fiber optic rod or light emitting diode disposed below the notch.

A preferred pistol, in which the rear sight includes a notch having two sides and the illuminated rear sight comprises at least an illuminated first fiber optic rod or first light emitting diode disposed below the notch, at least an illuminated second fiber optic rod or second light emitting diode disposed on one side of the notch, and at least an illuminated third fiber optic rod or third light emitting diode disposed on the other side of the notch.

A module adapted for mating with a slide of a semiautomatic pistol comprising:

one or more compartments housing a power source, light source and conduit that is configured to transmit light from the light source and provide at least an illuminated front sight positioned at a distal end of the module;

a power circuit that provides power from the power source to the light source when activated;

an optional passive switch that preserves or restores the power circuit when the pistol is deployed and breaks the power circuit when the pistol is not deployed.

A method of modifying a handgun equipped with a slide and front and rear sights comprising:

removing at least the front sight;

affixing to a top, distal surface of the slide a module comprising one or more compartments housing a power source, light source and conduit and further comprising a substitute front sight and manual switch accessible from an outer surface of the module, which manual switch completes a power circuit that provides power from the power source to the light source when activated, said conduit configured to transmit light from the light source and provide an illuminated substitute front sight.

A preferred method, which further comprises activating the manual switch.

A preferred method, in which the module further comprises a passive switch that preserves or restores the power circuit when the handgun is deployed and breaks the power circuit when the handgun is not deployed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

Traditional 'plain' front and rear sights may work reasonably well in well-lit conditions. However, such sights do not perform well in nighttime, low-light, or no-light conditions. To aid the user or operator in acquiring sights (or to give the user a reference point in the form of something that can be seen) in less than ideal lighting conditions, tritium gas-filled vials may be provided and/or installed in a front sight and/or a rear sight on a firearm. Tritium gas dimly glows in the dark, and when contained in a small vial, then installed in a gun sight, acts as a reference point representing the sight or the position of the sight it is installed in, therefore giving the operator an aiming reference.

The illumination provided by the tritium gas allows a shooter (i.e., a user or operator) to see the tritium in the vials, which therefore provides the shooter with reference points that are critical for accurate shooting. To aid the shooter in seeing the vials of such sights, some vials may have a painted ring around them. The painted ring may be of some benefit in lit conditions, but does not aid in acquiring the sights in low-light or no-light conditions. In certain lighting conditions, tritium gas is too dim to provide the necessary illumination to assist the user in acquiring the sights for accurately shooting the weapon. Moreover, in addition to being relatively dim, the tritium gas has a further drawback in that it may escape or leak from the vials, or decay over time. If escape or leakage occurs of tritium occurs, the sights will no longer be illuminated, and therefore, in low- or no-light conditions, the shooter may have more difficulty and take more time to acquire the sights.

Further, fluorescent paint may be applied to sights in an effort to assist the shooter in acquiring the sights in low- or no-light conditions. However, the fluorescent paint generally requires a "light source" to be shone on the paint in order for the sights to glow. Thus, fluorescent paint is impractical for law enforcement or self-defense shooting applications, in which using a light source may be undesirable and/or infeasible. Additionally, such an approach is impractical and inefficient for competition shooting in low- or no-light conditions.

Yet another approach for illumination of sights includes employing fiber optic rods. A fiber optic rod comprises synthetic material that gathers and guides light along the length of the rod. The guided light is visible at the ends of the rod. In well-lit conditions, the ends of the rod are bright and stand out. The brightness aids the shooter in acquiring the end of the rod more quickly. However, in the absence of light or a light source, the fiber optic rod is analogous to the plain sights described above. Namely, like the plain sights, the fiber optic rods cannot be seen well in low-light conditions and cannot been seen at all in no-light conditions.

Further still, in certain systems, two different sight illumination methods may be used together. For example, metal sights may have fiber optic rods positioned above tritium vials. In well-lit conditions, the shooter may see the fiber optic rods, while in low-light or no-light conditions, the shooter may see the tritium vials. Although such a system seeks to enable the shooter to see the illuminations in low-light or no-light conditions as well as well-lit conditions, the system is prone to the same drawbacks identified above with regard to the use tritium vials. As mentioned above, these drawbacks include the failure of the tritium vials to provide adequate brightness for the sights to be acquired quickly. Further, in low-light or no-light conditions (without the provision of an auxiliary light source), the fiber optic rods cannot be seen.

Additionally, in some lighting systems, tritium vials are positioned at an end of a fiber optic rod to provide a light source for the rod. This system generally may be expected to function to provide a limited amount of light to the rod. However, the light provided by such a configuration does not illuminate the rods substantially. Furthermore, the rods cannot be changed, and the tritium vials only last for about a year. When the tritium vials become less effective due to escape, leakage or age, they do not provide sufficient light to the rods, and the entire sight must be replaced.

Moreover, as mentioned before, additionally light sources may be used to aid in sight acquisition. For example, handheld flashlights have been used to aid the shooter in low- or no-light conditions. Large, cumbersome flashlights do not lend themselves to fast accurate threat engagement or target engagement, however. Furthermore, with large flashlights, the shooter must dedicate one hand to activate and hold the flashlight. Also, the shooter must dedicate that hand to accurately direct the light beam towards the threat or target. Thus, the shooter must hold the flashlight away from the shooter's own body so that the shooter does not illuminate himself or herself. This results in the shooter shooting the handgun with one hand, which is not an efficient technique for shooting a handgun. Further, if the handgun jams or needs to be reloaded, then the shooter must conduct a one-handed immediate corrective action or a one-handed reload. Although the shooter may potentially put the flashlight down and conduct a two-handed immediate corrective action or a two-handed reload, in order to be more efficient, putting down the flashlight may take up critical time in a defensive situation.

Furthermore, some handguns may include or allow for a flashlight to be attached to the bottom of a dust cover of a frame of the handgun. Such configurations may "free up" the second hand of the shooter, so that the shooter can use two hands to manipulate the handgun. However, in such systems, the lights must be manually turned on and off. Further, such systems may fail to provide adequate illumination for the front sight, and rarely illuminate the rear sight, if at all.

In consideration of the foregoing, at least one embodiment disclosed herein advantageously eliminates the need for the beam of a flashlight to illuminate front and rear sights. In at least one embodiment, an outside power source is provided to illuminate the sights or illuminate a part of the sight, namely, a fiber optic rod. The collected light is then highly visible at the ends of the rod. The rod gathers light from a light emitting diode (LED), and not from the sun or an external light source such as the lights present in a room of a building structure. Thus, the rod continues to glow regardless of the external lighting conditions. The use of the LED with the rod advantageously allows a shooter to acquire the sight (in other words, to see the fiber optic rod), more quickly than the shooter could acquire plain front sights or even front sights illuminated by tritium gas contained in tritium vials.

Figure 3:
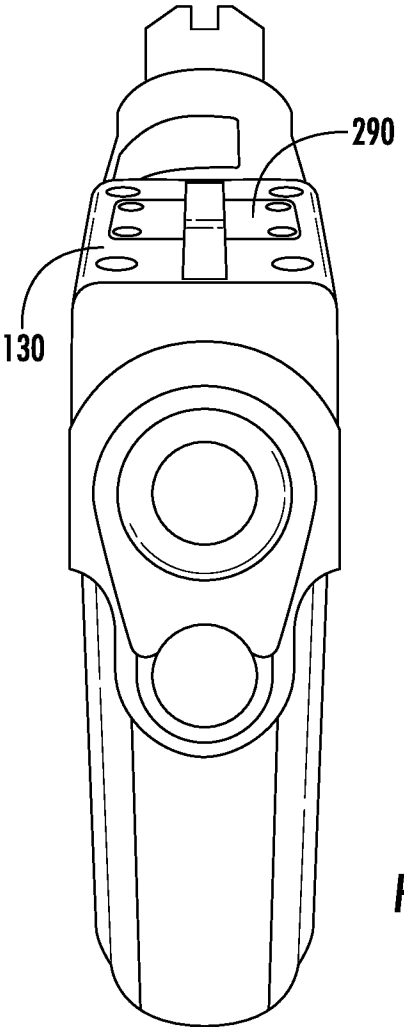
FIG. 3 depicts a rear view of the sighting system shown in FIG. 1.
Figure 2:
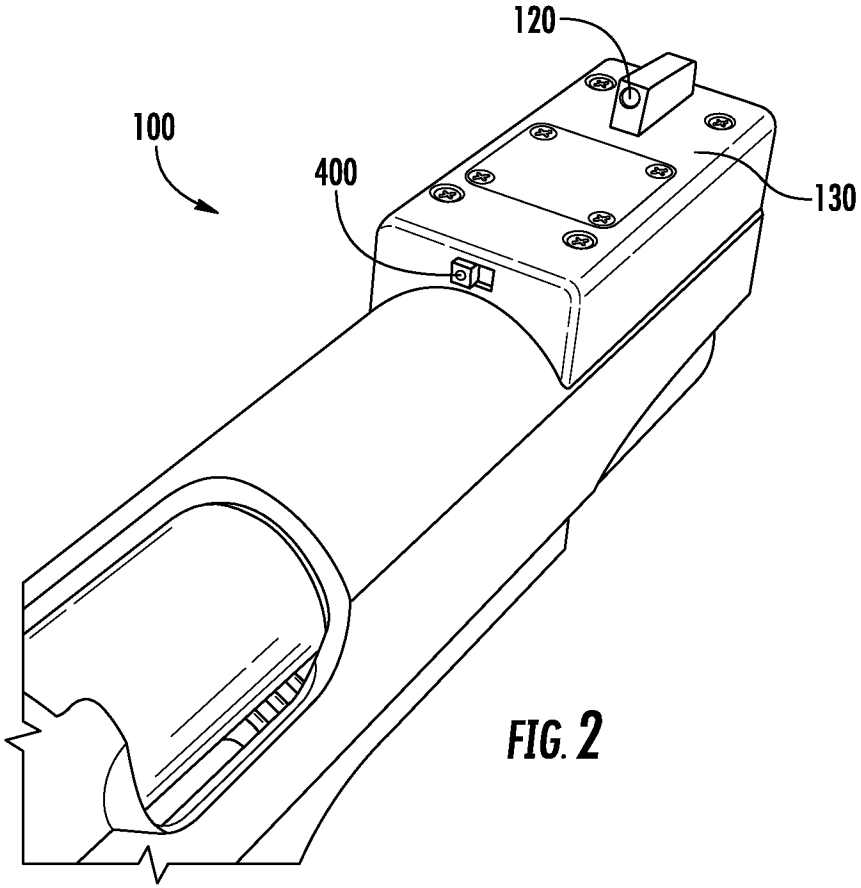
FIG. 2 depicts a detail view of the sighting system shown in FIG. 1, shown from an alternate angle.

As shown in FIGS. 1-3, an illuminated sighting system may be provided on a handgun. The sighting system is mounted on a slide 100 of the handgun. The sighting system includes a fiber optic rod or rods such as the rod 120 shown in FIG. 2, and a power supply which is preferably housed in a module 130. The module 130 may be attached to a top of a sliding mechanism of a handgun, commonly referred to as a slide. Such a system may be housed in the top of the slide and then shielded by a top or cover so as to be protected from the outside environment. Further, this system may be configured as a drop-in unit or an insertable unit that is placed in the top of a slide, such as the slide 100 shown in FIG. 1, and then protected by a cover attached to the slide. The drop-in configuration facilitates easy replacement of the sighting system, which may be provided as a standalone unit.

The sighting system includes a light source that provides light to be carried by the fiber optic rods to a region in the vicinity of the front side structure. As described herein, the light source preferably is an LED which projects light that is captured and carried by the fiber optic rods. The placement of the fiber optic rods is selected to allow the light to be easily acquired and seen by the shooter. The terminus of the rods, which displays the light to the shooter, can be positioned so that the shooter sees any suitable combination of lights such as for example a single illumination 120 in a front sight region 110 which can be aligned, by the shooter positioning the gun, with a corresponding illumination or illuminations in the rear sight area. Further by way of example the front sight may include a single illumination intended to be aligned with a pair of illuminations in the rear sight.

The front sight 110 of the sighting system may be mounted on top of the module housing. The front sight 110 may be configured at different heights to adjust elevation, and the rear sight (e.g., as shown in FIG. 1), may be configured at different heights to adjust elevation, and can also slide to the left or right to adjust to an individual's personal shooting nuances, differences or variations, and for the environmental conditions encountered by the shooter (e.g., wind). While shown as an illuminated sighting system for a semi-automatic handgun, the illuminated sighting system may be employed with other handheld weapons.

Figure 15:
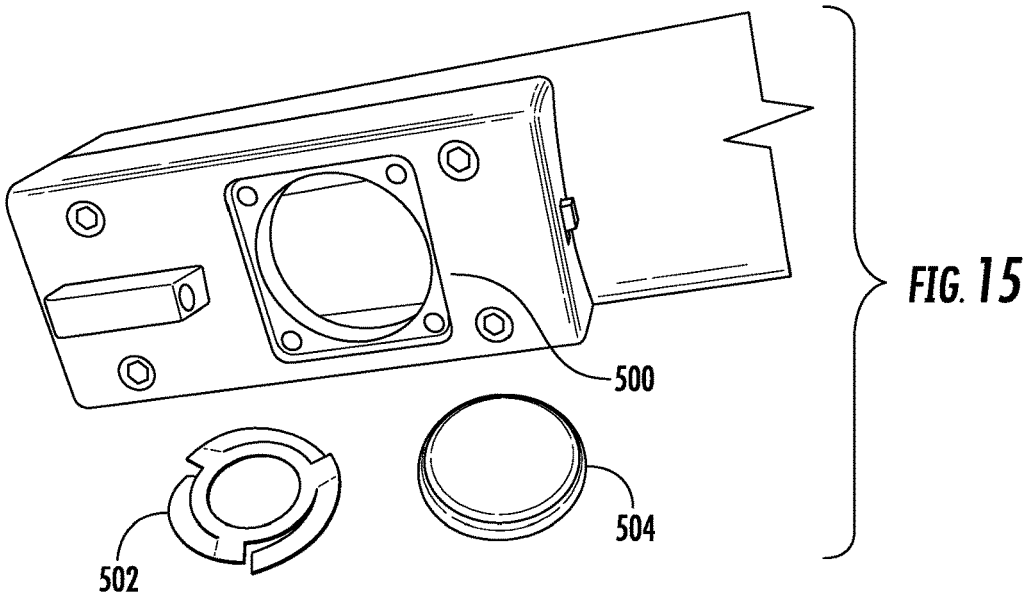
FIGS. 15-16 depict partially exploded views of the sight illumination system shown in FIG. 1.
Figure 16:
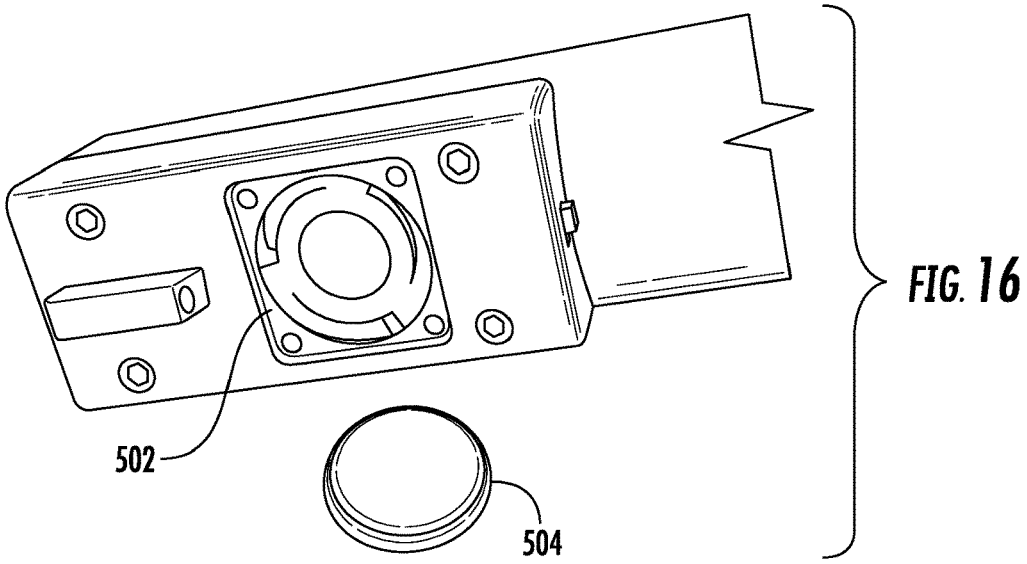
Figure 17:
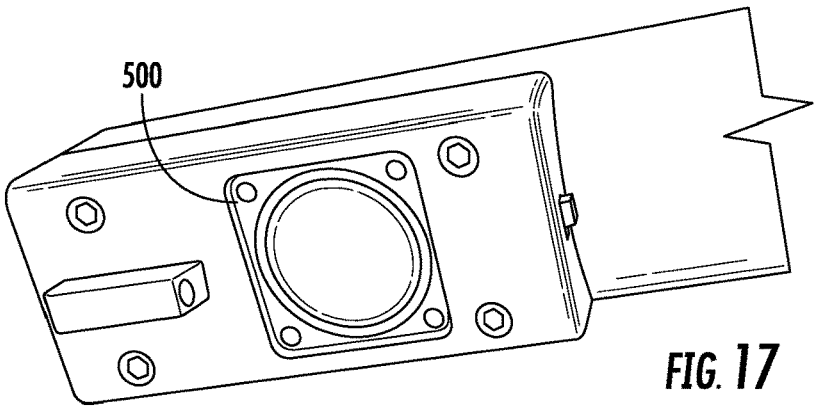
FIG. 17 depicts the sight illumination system shown in FIG. 1.

The module 130 may include a substantially circular or rectangular storage compartment 500 that houses at least a portion of a power source, e.g., a battery 504, as shown in FIGS. 15-17. A spring mechanism 502 may be provided for maintaining the battery 504 in position. The spring mechanism 502 may be a leaf spring and be substantially circular or rectangular. As an alternative to the configuration shown in FIGS. 15-17, the power source (e.g., battery) may be positioned within a portion of the handgun that falls below a rail mechanism under conventional use conditions. In such a configuration, the system may include conductor for carrying power to the light source which may be positioned remote from the power source, or the light source may also be positioned adjacent the power source.

Further, it should be noted that while there are references herein to acquiring sights, such acquisition is also understood as acquiring or seeing the viewing surface of the sights themselves, also referred to as the blades. By virtue of creating bright, easily ascertainable reference points on the blades of the front and rear sights themselves, certain embodiments herein provide superior illumination effects. Such superior illumination of the fiber optic rods in the front and rear sight blades is not achievable by traditional sighting systems or sighting additions (e.g., serrations, paint, tritium vials and/or combinations thereof.) This effect allows the user to more easily maintain focus on the sights when shooting in well-lit conditions, and especially in low-light or no-light conditions.

The improved illumination is particularly noteworthy and advantageous for the use of firearms in the context of law enforcement, tactical operations, defensive situations, and in competitive/recreational shooting. Such enhanced illumination of fiber optic rods in the sights allows the sights to be more easily seen or tracked by the user as the pistol is being presented towards the target/threat. Being able to see the sights as the handgun or pistol is in motion (either in the presentation phase towards a target/threat or during the recoil phase) greatly increase the efficiency of the user in aligning the sights and in shooting accuracy or in accurate shot placement. Not only can the sights be seen or acquired more quickly and easily in an initial shot, but such embodiments also increase the ease of tracking or watching the sights through a firearm's "lift and recovery cycle," also known as the recoil. Further, once the recoil cycle has ended, such embodiments allows for faster reacquisition of the sights for quick, efficient follow up shot placement.

Figure 7:
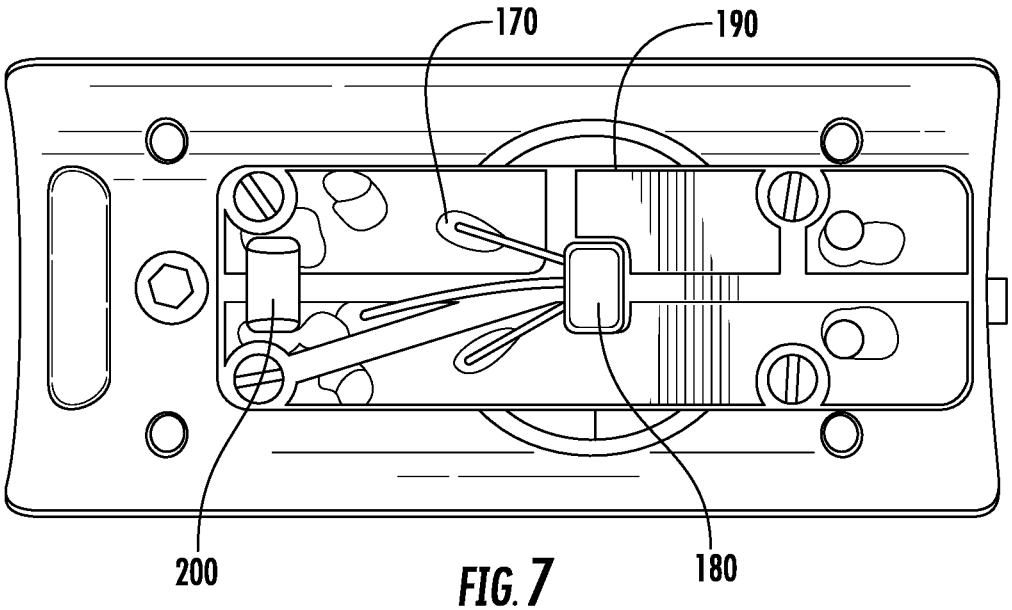
FIG. 7 is a bottom view of the illuminated sighting system shown in FIG. 1.
Figure 8:
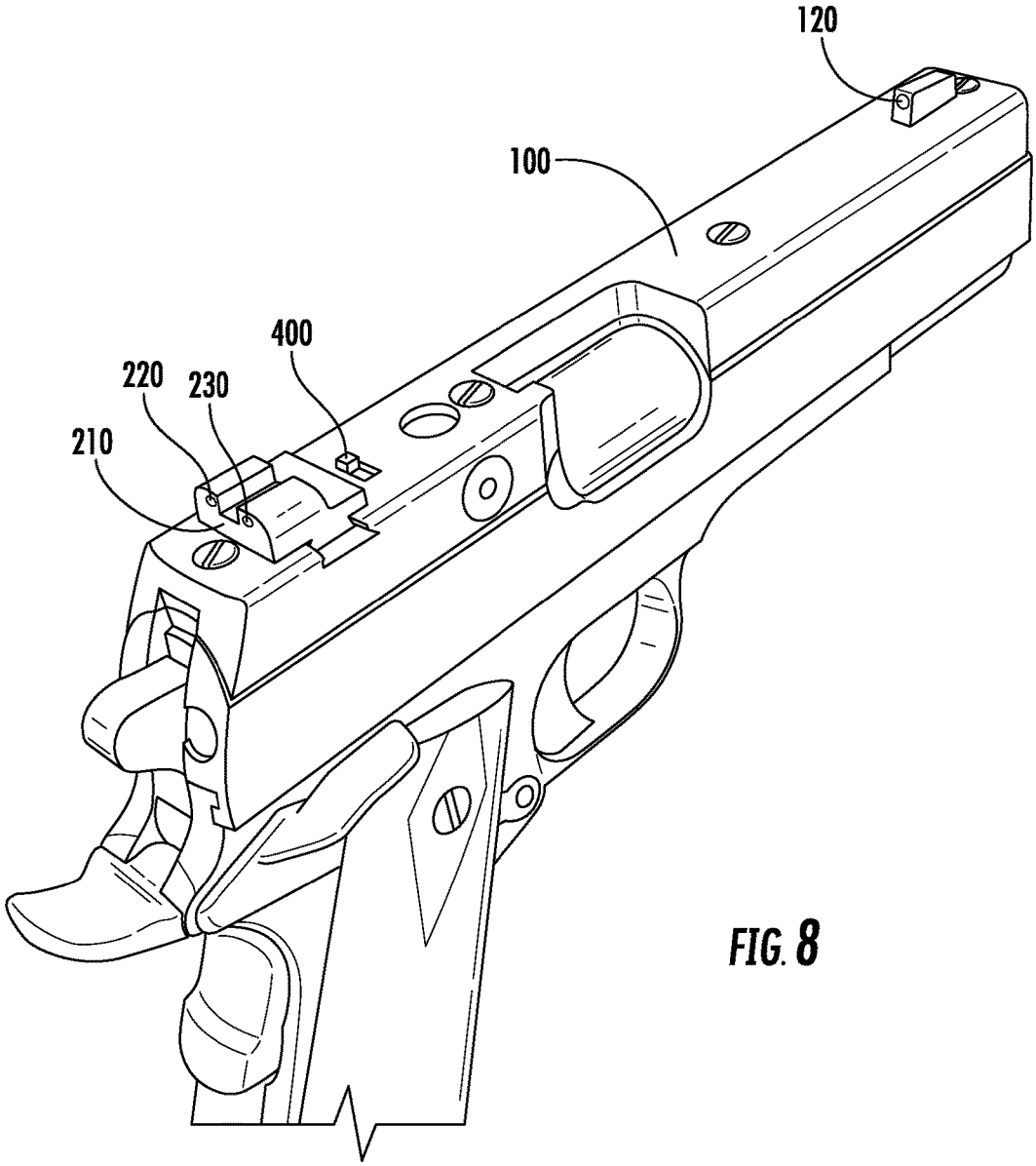
FIG. 8 depicts a perspective view of a firearm including an alternative embodiment of an illuminating sighting system.
Figure 9:
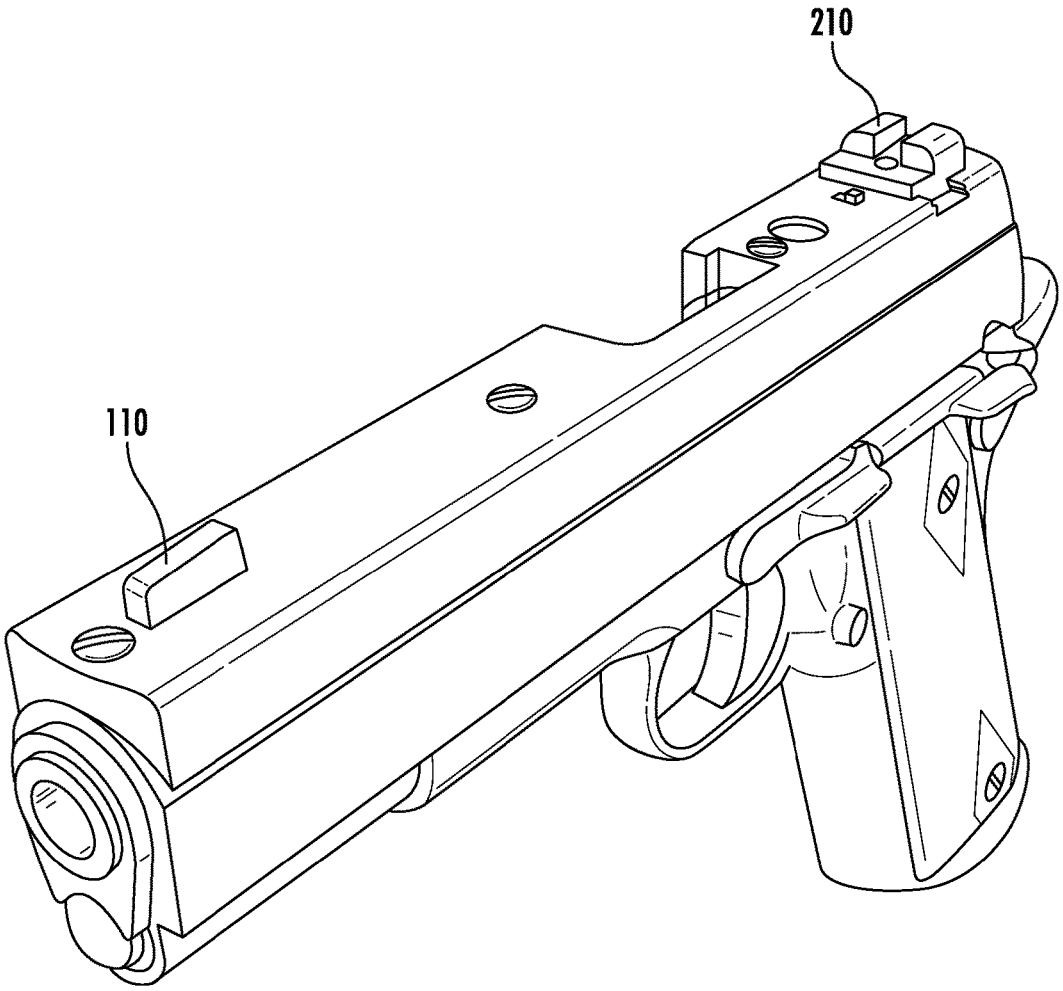
FIG. 9 depicts an alternative view of the firearm of FIG. 8.

Additionally, at least one embodiment includes two switches for activation and deactivation. A first switch may be mechanical and a second switch may be passive. An exemplary mechanical switch is an "on/off" switch, for example the sliding mechanical switch 400 shown in FIG. 1 and FIG. 9. An exemplary passive switch may be a Hall Effect sensor, as shown in FIG. 7. The manual switch 400 is accessible from an outer surface of the housing, which completes a power circuit that provides power from a power source to the light source when activated. FIG. 1 shows the switch 400 in an off position, while FIG. 2 shows the manual switch 400 in an on position. Alternatively, as shown in FIGS. 8 and 9, the manual switch 400 may be provided just forward of the rear sight. In yet another alternative, the switch is positioned along either side of the housing.

Figure 4:
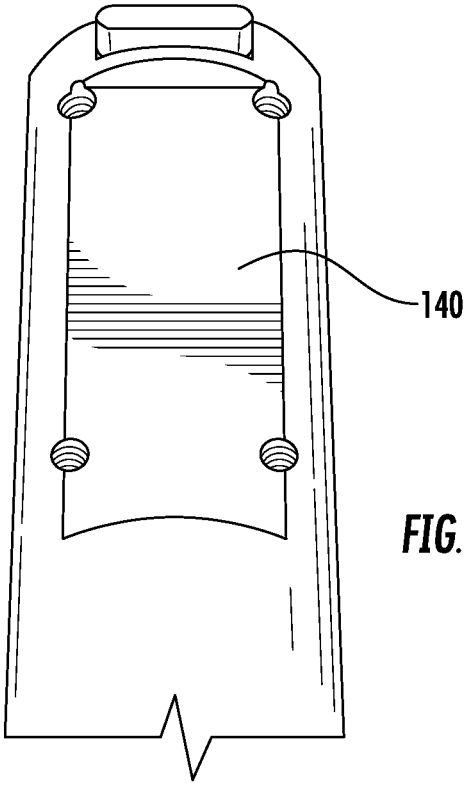
FIG. 4 depicts a top view of a portion of a firearm configured to receive the sighting system of FIG. 1.
Figure 5:
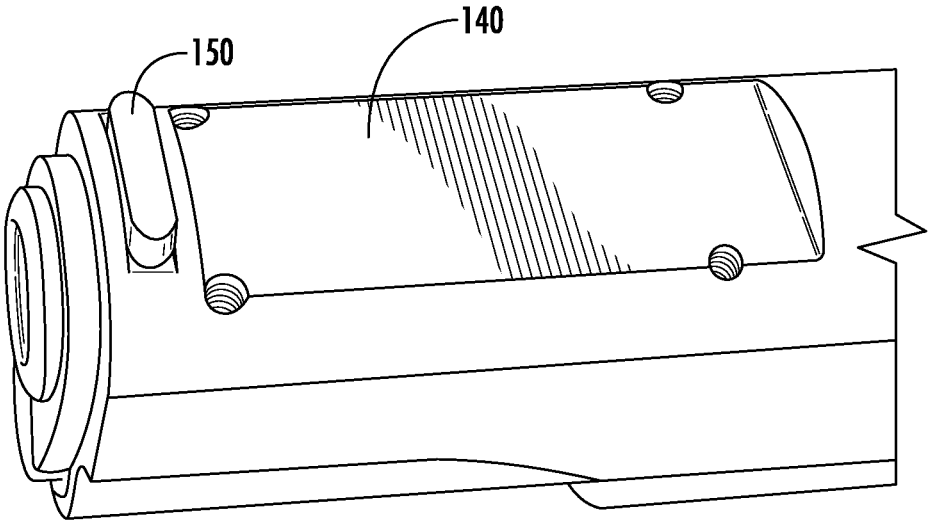
FIG. 5 depicts an alternative view of the portion of the firearm shown in FIG. 4 with a stabilization element removed.
Figure 6:
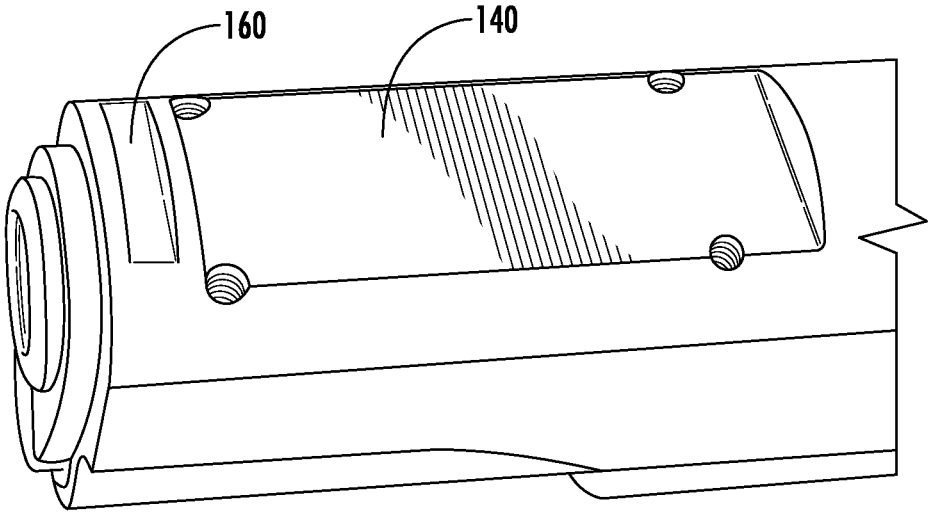
FIG. 6 depicts an alternative view of the portion of the firearm shown in FIG. 4.

FIGS. 4-6 show the supporting structure provided by the slide 100 that is located under the front lighting system module 130, shown in FIG. 1. The module 130 may be provided atop a recessed machined portion 140 of a top of the slide, as shown in FIG. 4. The machined portion 140 provides a level base for supporting the module 130. The front sight illumination system may be secured to the slide using fasteners. For example, threaded holes for receiving retaining fasteners are shown in FIGS. 4 and 5. An alignment mechanism 150 is also shown in FIG. 5. The alignment mechanism (e.g., a key 150) functions to mate with a corresponding detent or cavity in the module to align the illuminated lighting system module 130. The alignment mechanism serves as a stabilization member and may be configured as the rectangular bar 150 positioned orthogonally to the direction of the sliding movement of the handgun slide. The stabilization member or alignment mechanism 150 may engage a detent or cavity in the slide 100, as well as a corresponding cavity in the module 130, such as shown in FIG. 7 for example.

FIGS. 8-11 show an alternative embodiment of the illuminated lighting system. The lighting system includes a cover mounted on top of the slide of a handgun such as a semiautomatic pistol, for example. The system includes a front sight 110 including an illumination 120, and rear sights 210 with rear illuminations 220, 230, as shown in FIG. 8. A conventional pistol may be modified by removing at least the front sight, affixing to a top, distal surface of the slide an illuminated sighting module including one or more compartments housing a power source, light source and conduit and placing a substitute front sight and manual switch accessible from an outer surface of the cover overlying the slide. The manual switch 400 completes a power circuit that provides power from the power source to the light source when activated. The conduit is configured to transmit light from the light source and provide an illumination of the substitute front sight. The system may be configured with a single power source and a single light source that is configured to provide light for the front sight and rear sight illuminations. Alternatively, the system may be configured with separate rear sight and front sight illumination systems, with each system including a dedicated light source and power source. In another modification, the front and rear sight illumination systems may share either the power source and/or the light source. Each of the illuminations 120, 220, 230 includes a dedicated fiber optic rod for carrying the light from the light source to the location on either the front or rear sight where the light is visible to the shooter. The system further includes a switch 400, as shown in FIG. 8. The switch 400 may comprise any of a number of conventional switch configurations such as, for example, a toggle switch, pressure plate, etc. When the switch is provided and used, the user must activate the switch to complete a power circuit that provides power from a power source to a light source before the illuminations are visible to the user.

The light source produces an illumination of at least one sight of the firearm via a light transmitting conduit. The light source may produce an illumination at a rear sight of the handgun as shown in FIG. 8. If the rear sight includes split posts, the illuminations may appear in any one of three different configurations. Illuminations may be positioned on each of the split posts, or in a middle location under the V or U shaped notch formed by the posts, or on both the posts and under the V or U shaped notch formed by the posts. Regarding the front sight, preferably a single illumination is presented on the single projection forming the front sight, but in alternative configurations more than one illumination may be provided (e.g., two or more illuminations vertically aligned). Furthermore, if the front sight includes multiple projections or a notched configuration, for example, the illuminations provided by the fiber optic rods may be positioned in a suitable manner to assist the shooter in aligning the gun.

Figure 18:
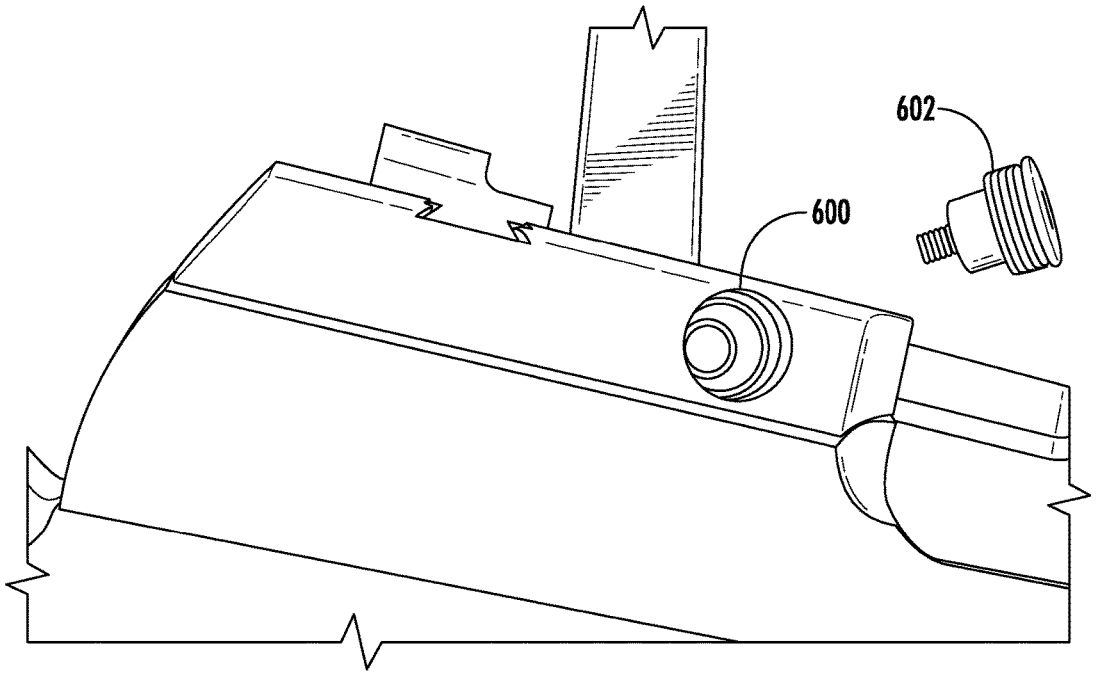
FIGS. 18 and 19 depict an attachment mechanism for the illuminated sighting system shown in FIGS. 8 and 9.
Figure 19:
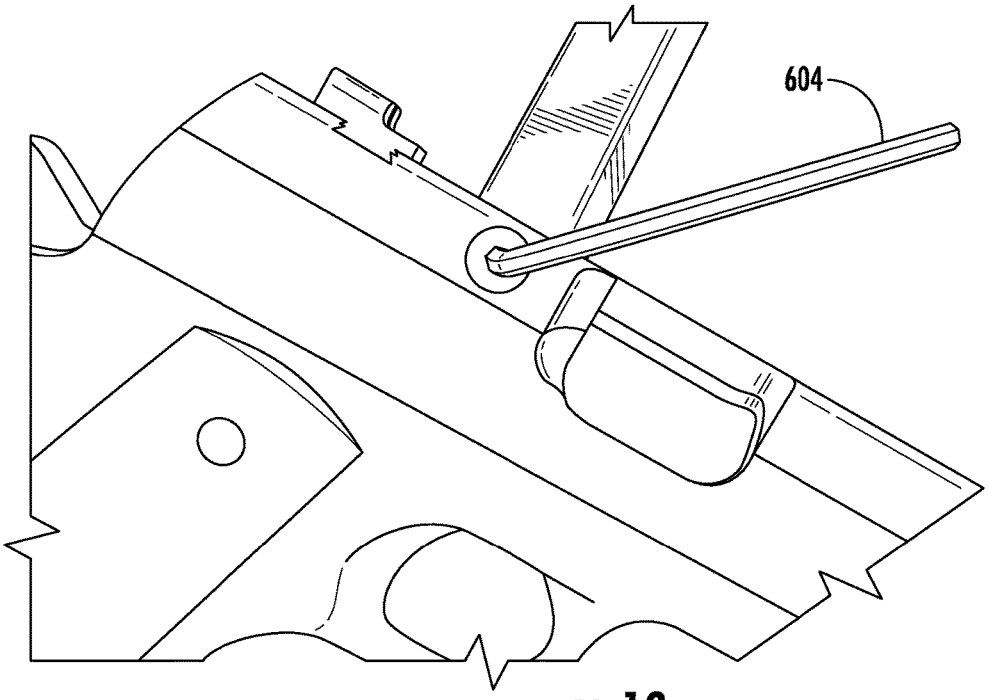

The lighting module 130, shown in FIG. 1 may be secured to the slide 100 using screws, for example. The module housing may be removed for easy access to the interior components—for example, via the top screws shown in FIGS. 2 and 3. For example, the power source (e.g., battery) may be replaced without disturbing the slide mechanism. In contrast, illumination systems that are located interior to the slide, suffer from the drawback of requiring a top portion of a slide to be removed, which entails removal of very small screws. Such existing designs make access much more difficult than the disclosed system, in which a shooter can simply leave a top unit on a firearm and may remove screws (shown in FIG. 1) with a basic wrench to access the batteries inside. In the embodiment shown in FIGS. 8 and 9, a screw cap system is employed to secure the cover enclosing the illuminated sighting system components. For example, as shown in FIG. 18, a circular bore 600 is provided into which a screw 602 is inserted for fastening the cover to the slide. The screw 602 may be easily removed using a tool such as an Allen wrench 604 (e.g., a hex key), as shown in FIG. 19.

Figure 10:
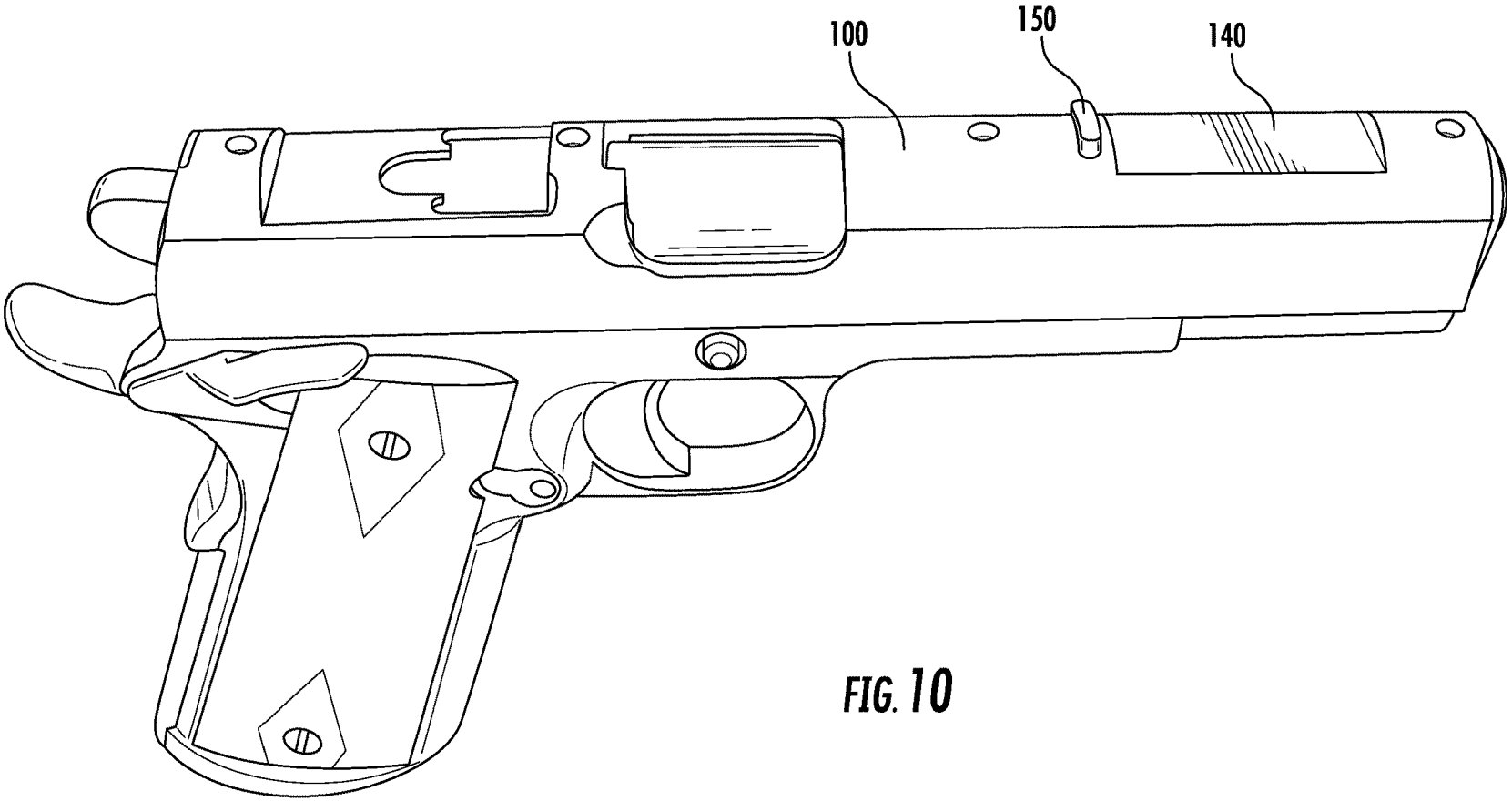
FIG. 10 depicts a top view of a firearm configured to receive the sighting system of FIGS. 8 and 9.
Figure 11:
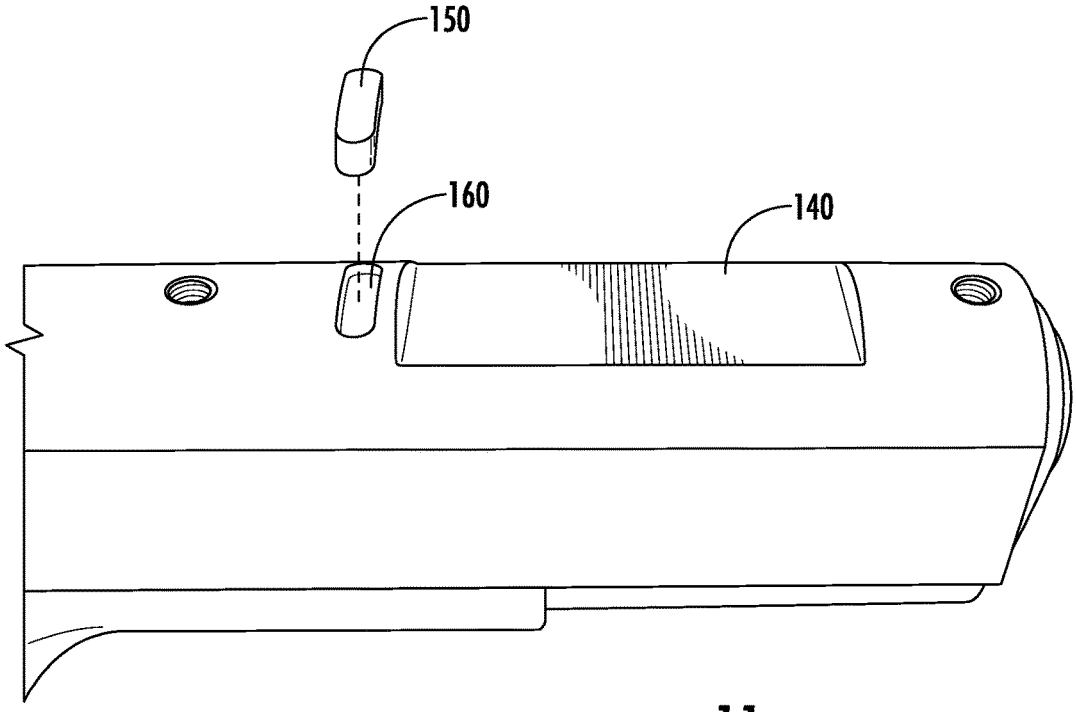
FIG. 11 depicts a view of a portion of the firearm of FIG. 10, showing an alignment device separated from the firearm.

As shown in FIG. 10, the illuminated sighting system may be mounting on the slide 100. The slide may include two machined supporting surfaces 140. One of the machined surfaces supports the illuminated front sight and one of the machined support surfaces supports the illuminated rear sight. Each of the surfaces may include an alignment groove or cavity such as shown, for example, in the surface supporting the rear sight. Also, as described above, a stabilization element or key 150 may be used for aligning and stabilizing the cover overlying the lighting system components and the slide 100. The stabilization member or element, such as the embodiments shown in FIG. 11, may be formed as a rectangular bar 150 positioned orthogonally to the direction of the sliding movement of the handgun slide. The stabilization member of FIG. 11 is configured to engage in a receiving portion 160 of the module housing that has a recess contoured to mate with the stabilization member. Similarly, as described above, the module housing 130 of the system disclosed in FIG. 1 may include a mating recess or detent for engaging the key 150. Further, as shown in FIG. 11, the stabilization member 150 is aligned parallel to a machined recess 140 in a top portion of a slide.

Figure 12:
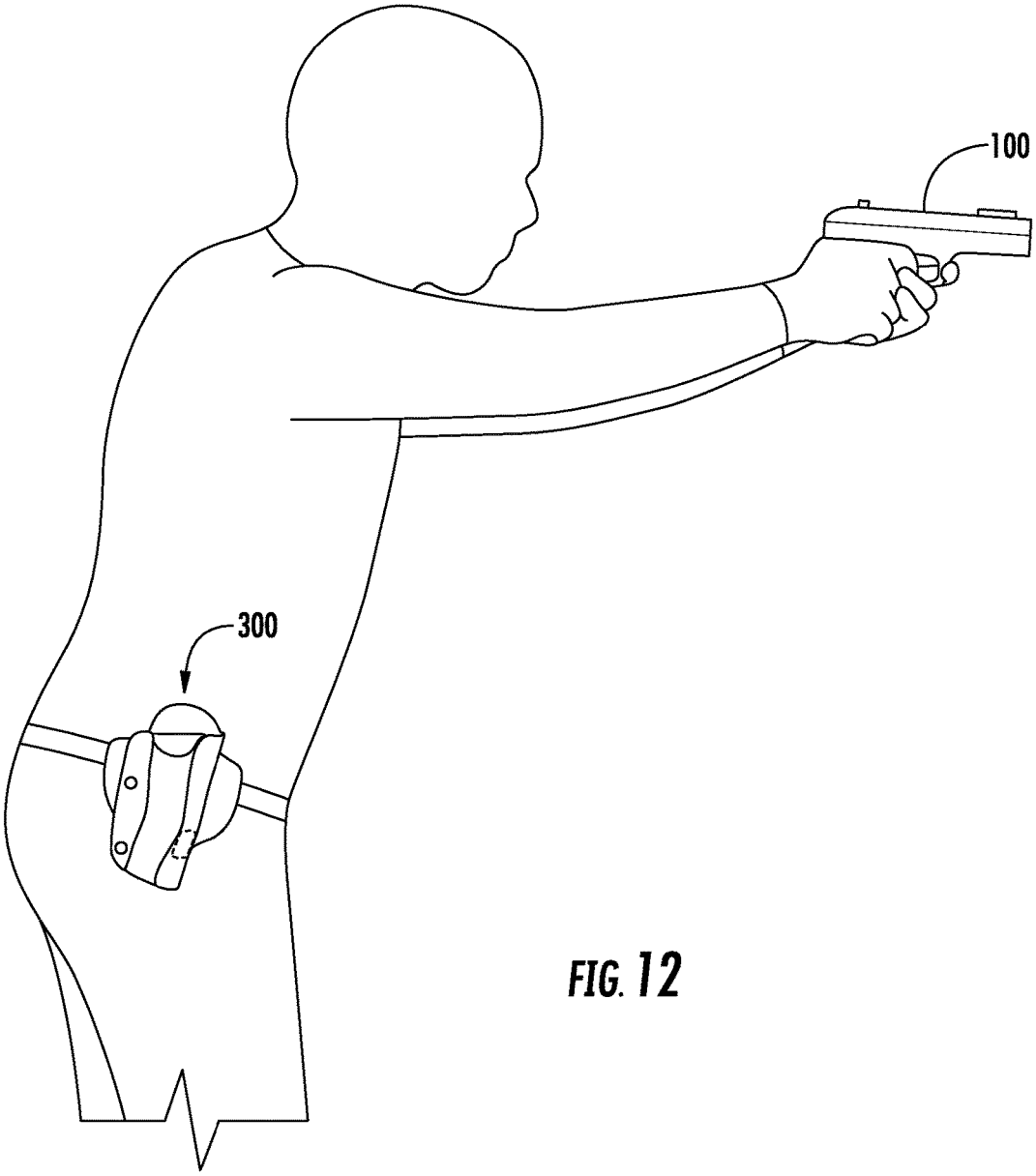
FIG. 12 depicts a user with a firearm and holster.
Figure 13:
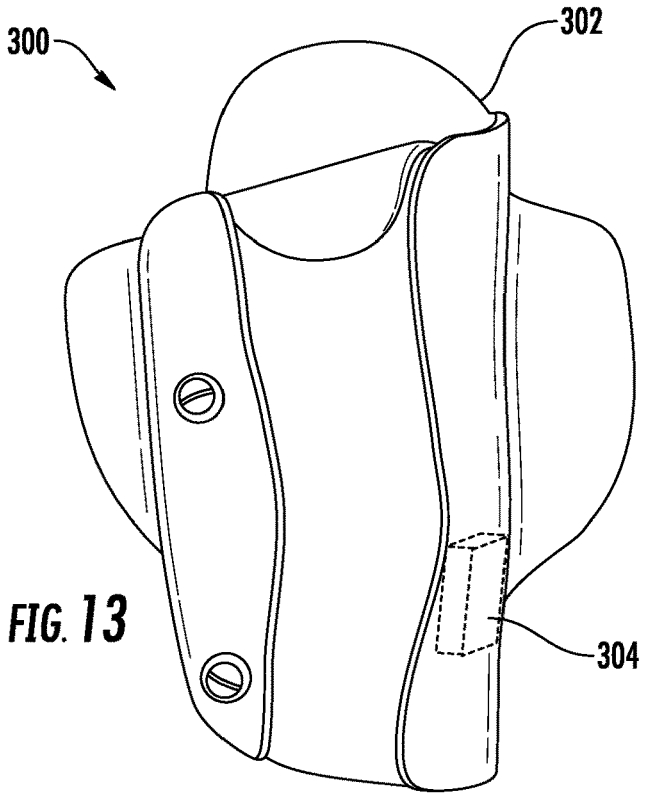
FIG. 13 depicts a holster system for a firearm with an illuminated sighting system.
Figure 14:
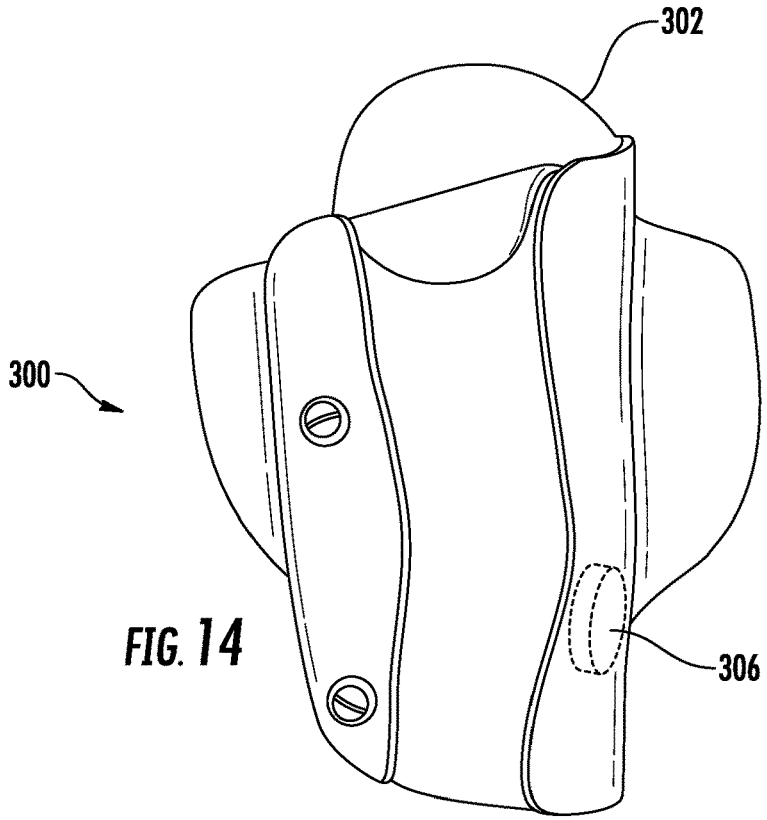
FIG. 14 depicts a holster system for a firearm with an illuminated sighting system.

The passive switch may be employed to deactivate the illumination system (e.g., interrupt power to the light source) when the firearm is in a stored condition. A Hall Effect sensor may be used in the passive switch. The Hall Effect sensor is activated when the sensor comes into close proximity to a magnetic field. The magnetic field disrupts the electric current, such that the embodied illuminative device is turned "off" until the firearm is removed from the magnetic field. The electronic circuit is then allowed to flow, and illuminative device is turned back "on." Such a feature allows for the illumination system to be manually or automatically turned on and then, when placed in a modified holster that has a magnet positioned in close proximity to the Hall Effect sensor, the system is turned off, saving battery power. When withdrawn from the holster, the power to the light source is restored and the illuminations immediately become visible to the shooter. FIG. 12 depicts a user deploying a handgun and wearing a holster system 300. As shown in FIGS. 13 and 14, a holster system 300 includes a holster 302 in which a magnet is disposed at an appropriate position. The magnet may be a rectangular magnet 304 as shown in FIG. 13, or a round magnet 306 as shown in FIG. 14. The magnet may have other variations in size, shape, and magnetic force.

Further, it should be noted that when the firearm is drawn from the holster 302, the illuminative device may be automatically and immediately turned back on. If a manual switch is provided. The manual switch is maintained in the "on" position to allow the automatic feature associated with the passive switch to be utilized. Such a benefit may be extremely advantageous in law enforcement applications, for example. The embodiments are configured such that when an officer must deploy his or her firearm in a defensive situation, the illuminative device is automatically turned on, allowing the officer to quickly see, and acquire the firearm's sights in order to defend civilians, other law enforcement personnel and themselves. The power supply can be easily maintained by the user. For example, the illuminated sighting system may be powered by conventional batteries that are off-the-shelf, inexpensive and widely available. The batteries may be positioned in a battery compartment that is accessible from the outside surface of the housing, as described above with reference to FIGS. 15-17.

In certain embodiments, elements of the power supply system (including the aforementioned switches) provide the benefit of being reliable and durable, as well as helping in conserving battery power, as noted above. By conserving battery power, such embodiments help to ensure that power is available when the shooter next accesses the firearm. As an alternative the mechanical switch 400, an electronic switch may be provided. An electronic switch requires electrical power to toggle the switch between the on and off position and, also, to maintain the switch closed to ensure power is provided to the light source. Thus, if power is momentarily interrupted such as, for example, due to batteries jiggling when the handgun slide is cycling the electrical switch may toggle to the off position and power to the illumination system may be interrupted. Once power is restored, when the batteries return to position, operator action is required to activate and close the switch allowing power to the light source to be restored. The present configuration minimizes the occurrence of such issues with the electronic switch by providing retaining devices for the batteries. These retaining devices include, for example, springs of various configurations and designs configured to ensure that the batteries stay in place.

In the case of mechanical switches, on the other hand, even if the battery or batteries break electrical contact with each other or the conductor carrying power to the light source when a shot is taken, the batteries would make contact again when the slide finishes cycling in its forward motion, and the light source would turn back on automatically without intervention from the operator. To help secure the batteries, a spring (such as shown in FIG. 15) may be provided on an end of a bolt or bolt-like component to hold in the batteries by providing additional force on the batteries to maintain the batteries in position. Springs of various configurations and designs, (as may be referred to herein as retaining devices, 'holding devices,' 'securing devices,' or 'locking devices'), among other components, may be incorporated to ensure that the batteries stay in place.

By way of example, FIGS. 20-24 depict various holding devices. The holding devices shown in FIGS. 20-24 are constructed to secure batteries in place and to support the circuit boards containing power circuit elements such as the Hall Effect sensor, for example. In the embodiments of FIGS. 20-24, no manual on/off switch is provided. Rather, a magnet acts as the power switch. As described above, the Hall Effect sensor is activated when the sensor comes into close proximity to a magnetic field. In certain alternative embodiments, a manual on/off switch may be provided in addition to the magnet.

Figure 20A:
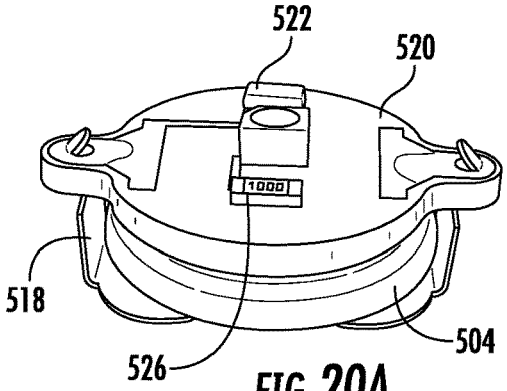
FIGS. 20A, 20B, 20C, 20D, and 20E depict a holder of a power source.
Figure 20B:
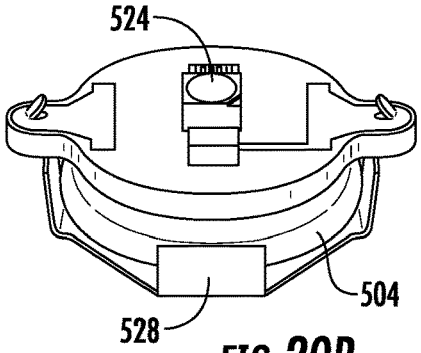
Figure 20C:
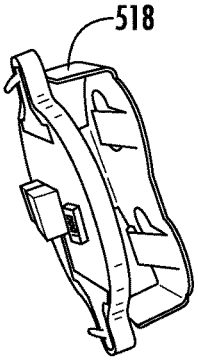

FIGS. 20A-E depict a holding device configured to ensure that a battery such as the battery 504 of FIGS. 15-16 remains securely in place. The battery 504 may be a coin battery such as the 3V Lithium CR1632 battery manufactured by Renata or a 3V CR 1632 battery manufactured by Panasonic Corp., for example. As shown in FIG. 20A, a battery holder 518 includes a plurality of clips on a perimeter thereof to secure the battery 504. The battery holder 518 is constructed such that the clips thereof contact with portions of a rounded circuit board 520. A Hall Effect sensor 522, a light emitting diode (LED) 524 and a resistor 526, collectively forming a power circuit, are mounted on the circuit board 520. FIG. 20B depicts the battery holder 518 including a clip 528 which retains the battery 504. FIG. 20C depicts the battery holder 518 in profile.

Figure 20D:
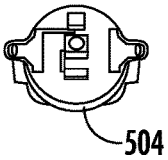
Figure 20E:
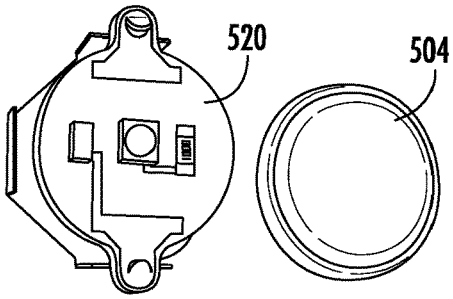

FIG. 20D depicts the battery holder 518 containing the battery 504. The battery holder 518 is positioned directly under the circuit board 520, and the battery 504 slides in and out of the holder 518. In this configuration, servicing of the battery 504 entails removing the sighting system. As shown in FIG. 20D, the size of the circuit board 520 is roughly the size of a dime. The diameter of the battery holder 518 is approximately the same size as the circuit board 520, well under one inch. FIG. 20E depicts the battery holder 518 next to the battery 504. As apparent from FIGS. 20A-20D, the battery clips 528 permit the battery 504 to be held in place, so as to avoid relying on a battery compartment top or other similar structure to force down the battery 504 and keep it in place.

Figure 21A:
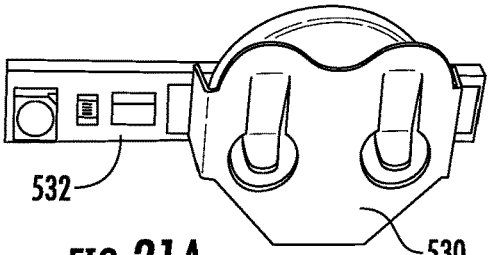
FIGS. 21A, 21B, 21C, and 21D depict an alternative holder of a power source.

FIGS. 21A-D depict an alternative battery holder. As shown in FIG. 21A, a battery holder 530 is formed as a pocket having two slots therein. The holder 530 is constructed as a surface mount horizontal holder to hold the battery 504. The holder 530 is attached to a circuit board 532. In contrast to the circuit board 520, the circuit board 530 is constructed as a relatively narrow strip of rigid printed circuit board material (e.g., FR-4 class laminate). The circuit board 532 is approximately 3/16" in width by approximately 1¼" in length. The circuit board 532 is arranged with the battery holder 530 such that the battery holder 530 is on top of the board 530. Such an arrangement facilitates easy access to the battery 504.

Figure 21B:
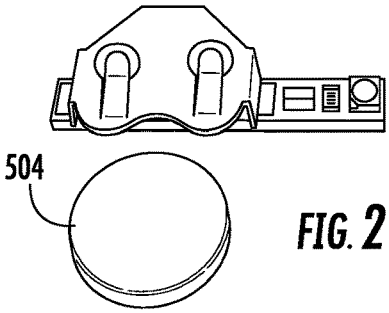
Figure 21C:
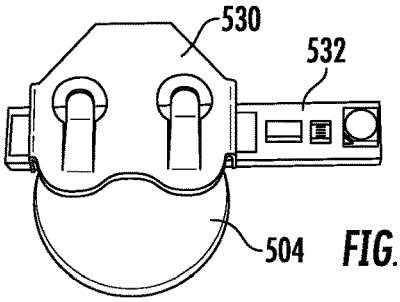
Figure 21D:
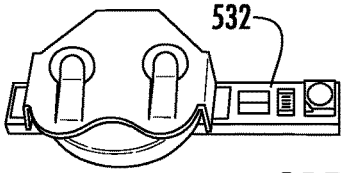

Referring again to FIG. 21A, the battery 504 slides in and out of the holder 530, similar to the holder 518 of FIGS. 20A-E. An access panel on the housing is provided to permit access to the battery 504 and holder 530. The panel may be provided on a compartment such as the compartment 500 shown in FIGS. 15 and 17, for example. FIG. 21A depicts the holder 530, the circuit board 532 and the battery 504 assembled together. FIG. 21B depicts the holder 530 and board 532 assembled together, with the battery 504 not secured in the holder 530. FIG. 21C depicts the battery 504 partially placed in the holder 530. FIG. 21D depicts the holder 530 with the board 532 and battery 504 in an alternative orientation from FIG. 21A.

Figure 22A:
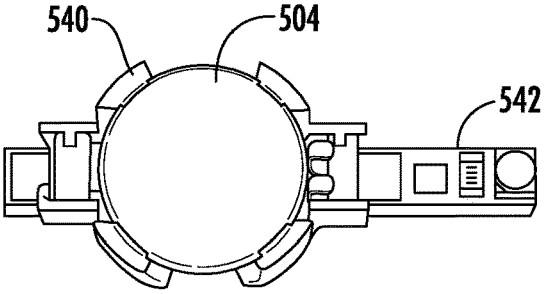
FIGS. 22A-22B depict another alternative holder of a power source.
Figure 22B:
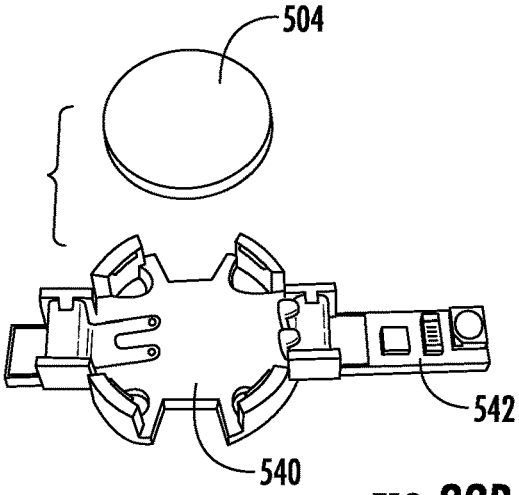

FIGS. 22A-B depict another alternative battery holder. As shown in FIG. 22A, a battery holder 540 is constructed so as to retain the battery 504 in place. The battery holder 540 is formed of a rigid plastic, such an ABS polymer or liquid crystal polymer. The holder 540 is disposed atop a circuit board 542 having approximately the same dimensions as the circuit board 532 of FIGS. 21A-D. FIG. 22A depicts the battery 504 secured in the holder 540 attached to the circuit board 542, while FIG. 22B depicts the holder 540 without the battery 504 secured within. The holder 540 is constructed such that the battery 504 may be more easily accessed than in the holders 518 and 530 of FIGS. 20-21. Specifically, the battery 504 can be easily placed in the holder 540 and then popped out of the holder 540 for replacement. Thus, the access panel may be designed to allow the battery 504 to be popped out, rather than slid out of a holder, as is the case for the holders of FIGS. 20-21.

Figure 23:
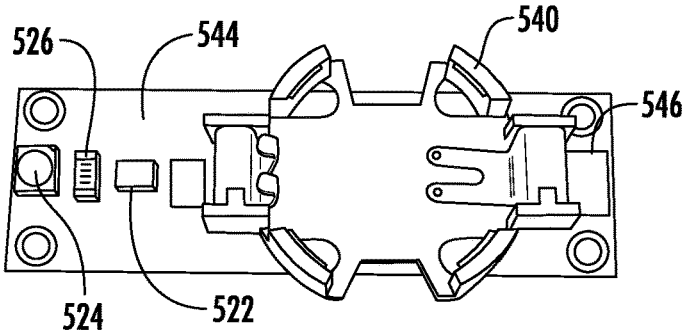
FIG. 23 depicts a further alternative holder of a power source.
Figure 24:
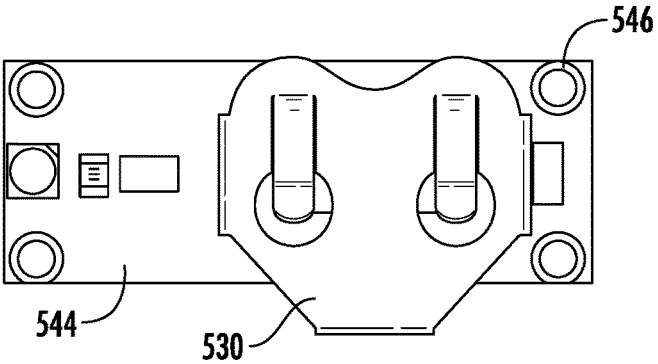
FIG. 24 depicts yet another alternative holder of a power source.

As described above, the battery holders of FIGS. 20-22 are configured to be accessed from an access panel, and thus a 'pocket' or compartment such as compartment 500 is provided to accommodate the holder, battery and circuit board. Batteries placed in these holders may be easily accessed and replaced. However, in certain alternative embodiments, the holder and circuit board attach to the housing and are not inserted in a pocket therein. FIGS. 23 and 24 depict alternative arrangements of battery holders and printed circuit boards. FIG. 23 depicts the holder 540 described above on a circuit board 544. The circuit board 544 is approximately ⅜" in width or ¼" in width by 1¼" in length. The Hall Effect sensor 522, light emitting diode (LED) 524 and resistor 526 are mounted on the board 544. FIG. 24 depicts the holder 530 shown in FIGS. 21A-D mounted on the board 544. The board 544 includes holes 546 drilled into the board to facilitate attachment to the housing unit. The holes are connection points provided in the corners of the board. The housing assemblies of FIGS. 23-24 are fixable directly to the housing module 130, in contrast to the embodiments of FIGS. 20-22. The housing assemblies of FIGS. 23-24 may require additional time for replacing batteries therein but may have enhanced durability by virtue of fixing the battery and holder to the housing itself.

Moreover, certain embodiments of the illuminated sighting system allow the firearm (e.g., handgun such as a semiautomatic handgun) to maintain a compact form factor and are provided as relatively small additions to the top of a slide of the handgun. For example, as shown in FIG. 10, multiple components of the illuminated sighting system may be arranged on the top of the slide 100. In other alternative embodiments, the illuminated sighting system includes components positioned on sides of the handgun slide. Because the sighting system is compact and has a low mounted design, the associated firearm may be easily fitted to current holster designs, with certain modifications. Also, at least some embodiments of the illuminated sighting system obviate the need for a handheld or weapon mounted flashlight to illuminate the sights. Such embodiments thereby allow a shooter to use a two-hand hold on the handgun, which is more efficient than a one-hand hold, while being able to see the sights in low- or no-light conditions.

As indicated above, at least some embodiments may be particularly advantageous for law enforcement. By way of further illustration, consider a police officer who is outside a building in daylight conditions. Once the police officer enters a building, the officer may be subject to low- or no-light conditions. If the officer has to draw his or her weapon quickly in such a situation, the illuminated sighting systems disclosed herein allow the officer to see the sights on his or her duty weapon without the use of a handheld or weapon mounted flashlight. Such embodiments permit the officer to deploy his or her weapon with both hands, and not take critical time to turn on a switch or to use an inefficient grip to deploy and use the handgun with one hand while holding a flashlight in the other hand.

Furthermore, the illuminated sighting systems disclosed herein may aid inexperienced shooters during firearms training by allowing such shooters to see firearm sights more easily and efficiently. The inexperienced shooter can track the sights more easily, resulting in more efficient training and successful target engagement. In addition to aiding inexperienced shooters, at least some embodiments may aid competitive shooters who shoot during competitive events with low- or no-light conditions.

Additionally, at least some sighting systems may include a self-contained power supply that provides power to illuminate LEDs, which in turn provide light that may be gathered by the fiber optic rods, such as the rod 120 shown in FIG. 2. The light that is gathered is then carried to the ends of the rods, where the light may be amplified to increase the intensity. The brightly illuminated ends of the rods allow the shooter to quickly acquire and maintain focus on the rods in the sights, thereby allowing for faster, quicker and more accurate acquiring, seeing, and focusing on the sights during all phases of shooting a handgun, i.e., during presentation, initial sight alignment, firing, watching the sights or tracking them while the slide is recoiling, and then re-aligning the sights. Therefore, a firearm including the disclosed illuminated lighting systems may aid in faster, quicker and more accurate threat or target acquisition and initial shot placement, as well as faster, more accurate follow up shots and bullet placement, than firearms including plain metal sights, painted sights, tritium vial sights or other conventional sighting systems.

In view of the foregoing, it should be appreciated that the disclosed illuminated sighting systems allow for numerous advantages and benefits. Such benefits include, but are not limited to, allowing a shooter to see the sights of a handgun more easily; providing for a system in which elements such as fiber optic rods may be easily replaced; including a power system that is easy to maintain and includes replaceable components (e.g., easily replaceable batteries); providing sights that may be replaced relatively inexpensively (e.g., fiber optic rods which are less expensive than tritium); a configuration which allows for the shooter to easily change the front and/or rear sights to adjust for horizontal and vertical bullet impact; and allowing the shooter to easily change the color of the sights by simply replacing the aforementioned fiber optic rods, thereby allowing the shooter's color preferences to be readily accommodated.

Further, if a rod becomes damaged, the shooter may be able to change it within a matter of minutes, and typically without the assistance of others. In contrast, if a tritium vial becomes damaged, the sight has to be removed from the handgun and returned to the installer of the tritium vial for servicing. Such a repair process may take a long period of time, typically between four and six weeks. Also, by way of further illustration, at least some of the disclosed illuminated sighting systems aid in training of new, beginning or inexperienced shooters in firearms training. For handguns equipped with the illuminative systems and devices described herein, novice shooters can see the sights more easily in both well-lit conditions and low- and no-light conditions. These illuminated sighting systems may also aid those with visual impairments by providing sights that are brighter than other sights and which are easier to see.

In at least one embodiment, a method of deploying a handgun is provided. The method includes activating a manual switch affixed to a handgun to complete a power circuit that provides power from a power source to a light source. The light source comprises a portion of an illuminated sighting system for illuminating at least a front sight of the handgun. The method further includes pointing the handgun at a potential target while maintaining the illuminated front sight in a field of view. The illuminating sighting system further comprises a passive switch that preserves or restores the power circuit when the handgun is deployed and breaks the power circuit when the handgun is not deployed.

Moreover, in at least one embodiment, the method further comprises keeping the handgun holstered after the manual switch is activated. Additionally, the holster comprises an element that functions cooperatively with the passive switch to break the power circuit while the handgun is holstered. Furthermore, such a method may further comprise withdrawing the handgun from its holster prior to pointing the handgun at a potential target. The element in said holster works cooperatively with the passive switch to restore the power circuit while the handgun is deployed.

Further still, in at least one embodiment, holstering includes tucking away the handgun in a piece of clothing in proximity of an element that works cooperatively with the passive switch to break the power circuit while the handgun is tucked away. The piece of clothing may comprise a pair of pants or a skirt. The element that is sewed or stitched into or onto the piece of clothing or the element comprises a portion of an accessory. The accessory may be selected from the group consisting of a pendant, belt, badge, pin, brooch, ankle bracelet, stocking, socks, shoe, boot, wallet and pocketbook, for example.

In another embodiment, an illuminated sighting system for illuminating at least a front sight of a handgun comprises a power source housed within a compartment of a handgun, and a light source housed within the same compartment or a different compartment of the handgun. The system further includes a manual switch affixed to the handgun, which completes a power circuit that provides power from the power source to the light source when activated. Also included is a conduit configured to transmit light from the light source and provide an illumination of at least a front sight of the handgun. The illumination is generally directed at an operator of the handgun such that the operator, while maintaining the illuminated front sight in a field of view, can point the handgun at a potential target in a dimly lit, dark, or nighttime environment.

Moreover, in some embodiments, the system further comprises a passive switch that preserves or restores the power circuit when the handgun is deployed by the operator and breaks the power circuit when the handgun is not deployed by the operator. In certain embodiments, the light source produces an illumination of a rear sight of the handgun. Further, the rear sight of certain embodiments may comprise split posts (and/or the placement of a single illuminated fiber optic rod below the rear sight's notch), as mentioned above, such that the illumination of the rear sight includes an illumination of each of the split posts.

In addition, in some embodiments, the passive switch may be activated by detecting the proximity of the switch or a sensor to a magnetic field (e.g., a Reed switch or Hall Effect sensor). A Reed switch, as is known to those of ordinary skill in the art, comprises an electrical switch operated by an applied magnetic field, and typically consists of a pair of contacts on ferrous metal reeds in a hermetically sealed enclosure. The Hall Effect sensor may include variable transducer configured to provide a varying voltage. The passive switch is preferably configured to work cooperatively with an element (e.g., a holster, badge, pin, etc.) that is external to the handgun, such that the power circuit is broken when the passive switch is proximal to the element and the power circuit is preserved or restored when the passive switch is not proximal to the element. In some embodiments, the Hall Effect sensor may employ an integrated circuit such as the A3213 and A3214 integrated circuits produced by Allegro MicroSystems LLC of Worcester, Mass., as described in the Allegro Microsystems A3213 and A3214 Datasheets 27622.62-DS Rev. Y (2009), which is hereby incorporated by reference in its entirety for the technical descriptions and background information therein. As shown in FIG. 7, the Hall Effect Sensor may be located in the module 130 and may be integrated with logic components 170, a gate 180, a battery 190 and passive components 200, as shown in FIG. 7.

In some instances, the Hall Effect sensor may have lower power consumption, allowing the sighting system to remain on for approximately seven days. When in close proximity to a magnet, the sighting system may be in an idling mode or off state (from which the sighting system may enter the on state) for approximately nine to ten years. In particular, the sighting system may be provided with a relatively small magnet, e.g., a magnet equal to or smaller than the rectangular magnet 304 of FIG. 13, or the round magnet 306 of FIG. 14. The magnet may be provided in a case or other container, or with a wrap-around band so as to place the magnet in position so as to turn the sighting system off. Accordingly, in some embodiments, the on/off switch may be eliminated, thereby avoiding the need to purchase, install and replace the switch when broken. Furthermore, embodiments that employ a magnet as described above further benefit from avoiding an opening for an on/off switch, thus increasing the capability to be moisture-proof and water resistant.

Further, the system may be configured to provide a variation in an intensity of the illumination. Specifically, the intensity of the illumination can be increased to permit the illumination to be perceived by a user in a well-lit, bright, or daytime environment. Also, the intensity of the illumination may be varied between different sights provided on the firearm. For example, if a front sight is configured to be illuminated more intensely than a rear sight, the user may recognize a bright, intense illumination as corresponding to the front sight. By providing for variation in intensity, the system may aid in the user's quick acquisition of sights.

As mentioned above, in some embodiments, a light source produces an illumination of at least one sight of a firearm via a light transmitting conduit such as, for example, a fiber optic rod. Further, in certain embodiments, the lighting system includes three different conduits, each of which has a dimension (e.g., length, cross-sectional area) that is equal to one or both of the others. In other embodiments, the illumination is comprised of two conduits, one carrying light to illuminate a front sight and another carrying light to illuminate a rear sight. Each conduit may have a dimension that is equal or unequal to the other. The conduit(s) and light source(s) described herein may be configured to produce and carry light of different colors and intensities in order to assist the shooter in acquiring the illuminations/sights and shooting accurately.

The illuminated sighting system may be configured as a lighting module attached to a firearm. The module has a housing that may contain the light carrying conduit(s), the power source and at least one light source. Further, the module may be positioned above or within a sliding portion of the handgun. Alternatively, the module, or at least a portion of it, may be around or on at least one side of the sliding portion. The sliding portion of the handgun may be relatively narrow, and formed of highly machined metal. Thus, the module is preferably configured not to be bulky or unwieldy relative to the slide, while being accessible to a user.

The power source may optionally be accommodated within the housing. Further, the module also includes a passive switch that preserves or restores the power circuit when the handgun is deployed and breaks the power circuit when the handgun is not deployed. The handgun is considered not deployed when holstered or tucked away. As discussed above, FIG. 13 depicts a user who is using (i.e., 'deploying') the handgun, and further depicts a holster system 300 worn by the user for storing the handgun when the handgun is not being deployed.

The illuminated sighting system may be employed with a semiautomatic pistol having a slide, frame, trigger, grip and magazine well. For example, the pistol may include a module housing a light source and a conduit configured to transmit light from the light source and provide an illumination of at least a front sight positioned at a distal end of the pistol. Further still, the module includes a manual switch accessible from an outer surface of the pistol, which completes a power circuit that provides power from a power source to the light source when activated. The power source may be optionally accommodated within the same compartment that houses the light source and the conduit. Additionally, as in other embodiments, a passive switch may be provided that preserves or restores the power circuit when the pistol is deployed and breaks the power circuit when the pistol is not deployed.

Further, in certain embodiments, the illuminated sighting module may be integrated into the slide of the pistol. The module may further house the power circuit. The module housing is configured to shield the power circuit components from vibration, shock, and external environmental conditions (e.g., moisture and dust). The power circuit may comprise one or more circuit boards.

Further still, various alternative embodiments may encompass illuminative elements with a wide variety of configurations. For example, in some embodiments, all illuminative elements, such as LEDs, tritium-filled vials or 'lamps,' and fiber optic rods, may be structured so as to produce an illuminated area or region of the same size. In other embodiments, these components may be structured to produce illuminated areas having different sizes. For example, the sighting system could be configured to illuminate the front and rear sights so that the illuminated area of the front sight is a different size than the illuminated area of the rear sight. The entire surfaces of the sights facing the shooter may be illuminated with the front and rear sights having surfaces of different sizes and shapes. See, for example, FIGS. 8 and 9. For example, the illuminated area of the front sight may be slightly larger than the illuminated area (s) of the rear sights. Additionally, the same color or colors, or different colors may be used to illuminate the sights, e.g., green for the front sights and yellow for the rear sights. FIG. 8, by way of illustration, depicts an embodiment in which two rear illuminations and one front illumination are present.

As described above, certain sighting systems may illuminate the sights providing lighting of a variety of intensity, size and color. The various properties of the light and the accompanying sights may be varied in order to aid a shooter in differentiating between the front and rear sights more quickly. In embodiments in which the rear sights are slightly larger than the front sights, the size discrepancy can aid in differentiation. Providing different colors for the front and rear sights may also be a helpful differentiator. For example, in low- or no-light conditions where conventional metal sights cannot be seen, the disclosed system may illuminate the front sight with green light and the rear sight with yellow light. In this condition, if the shooter sees a large green dot, the shooter would recognize the front sight. If the shooter sees smaller yellow dots, the shooter would know that he or she is looking at the rear sight. Such embodiments differ from systems in which the same size of illuminations is used for both front and rear sights.

According to alternative embodiment of the illuminated sighting system, the power supply may be located distant from the lighting source. For example, certain pistols use an external grip (e.g., a 45 caliber 1911 pistol). In the 1911 pistol, the power source may be located in the grip portion and attached to a spring loaded plunger (or a spring loaded contact plate). The spring loaded plunger (or plate) applies upward pressure and rides against the bottom outward portion of the slide. The electrical power may be carried to the light source (e.g., an LED), for example, by wiring encased in an internal wiring channel concealed in the slide and/or along the bottom of the slide. For example, a contact strip of metal may be provided on the bottom of the slide and internal wires located in the strip may carry the power from the batteries in the grip to LEDs located above the slide. The electrical circuit may thereby be maintained between the batteries in the grips and the LEDs in the top of the unit when the pistol is being shot. Thus, the illuminated lighting system includes a module mounted on the slide powered by a remote power source.

As mentioned above, an illumination sighting system according to certain embodiments may include a mechanical switch in order to allow the user to deactivate the illumination sighting system when, for example, the user determines that the weapon does not need to be ready for immediate use. The manually activated switch may be implemented in a number of different ways. Further, in some embodiments, lighting components (including the front sight) may be fixed to the top of the slide (see FIG. 1). In alternative embodiments, lighting components may be placed in a hollowed out portion of the slide. A cover including the sights may be placed over the top of the slide, as shown in FIG. 8. As a further alternative, lighting components may be disposed on the side of the slide.

Further, as noted above, certain embodiments may include a mechanical or manual switch as well as a passive switch. The mechanical switch is akin to an "armed" button, meaning that the circuit may be readily armed and activated. Thus, toggling the mechanical switch to an 'on' state provides illumination to at least the front sight in one embodiment, and both of the front and rear sights in another embodiment. When off duty, for example, a law enforcement person may turn off the system using the mechanical switch, so that no battery power is consumed. Further, the mechanical switch may be toggled to require the illumination system to be turned off in well-light, bright conditions. To activate illumination of the sights in some embodiments, the gun is removed from the holster and the manual switch 400 (as shown in FIG. 2) is then toggled. The use of the manual switch may advantageously conserve battery life and allow the circuit to be reactivated if the batteries are jiggled and electrical contact is broken during the firing sequence.

Even when the system is turned on, however, the passive switch (e.g., a Hall Effect sensor, coupled with a magnetic field) keeps the circuit open and inactivated while the gun is in a holster, or stored in another position adjacent a magnet. When the gun is drawn from the holster, the circuit is closed and the sights are illuminated. In other words, when the gun is away from the influence of a magnet embedded in the holster, the circuit is closed and at least one of the front and rear sights is illuminated.

Additionally, at least some embodiments implement variations of certain components as described above so as to yield a plurality of alternative embodiments. In at least one such alternative embodiment, for example, an illumination system illuminates a single front sight only and a single rear sight only. In another alternative embodiment, at least one LED is used independently without accompanying fiber optic rods. Such LEDs are arranged with sight(s) formed in a hollowed-out portion of the slide. In other words, a top portion of the slide may be hollowed out, so as to facilitate attachment of a lighting system module to the top of the slide. Elements of the lighting system may be positioned in the hollowed out portion of the slide. For example, a printed circuit board or wiring assembly may be fitted in the slide, as may be a variety of electronic components. The module may include a cover disposed on top of the components and structured to be connected to a remainder of the top portion of the slide.

With respect to the use of substantially any plural and/or singular terms herein, those having skill in the art can translate from the plural to the singular and/or from the singular to the plural as is appropriate to the context and/or application. The various singular/plural permutations may be expressly set forth herein for the sake of clarity.

The constructions and arrangements of the illuminating systems, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Further, while at least some embodiments may be adapted to semi-automatic firearms, it should be understood that the foregoing embodiments may be implemented in a variety of firearms, including revolvers, rifles and shotguns.

Some elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. An illuminated sighting system for providing at least an illuminated front sight of a firearm comprising:

a power source held by a holder within a compartment of a firearm;

a light source housed within the compartment in which the holder is provided or within another compartment of the firearm;

a power circuit that provides power from the power source to the light source when activated; and a conduit configured to transmit light from the light source and provide at least an illuminated front sight of the firearm, the illumination generally directed at an operator of the firearm, wherein the compartment within which the power source is held by the holder is a drop-in unit insertable in a portion of the firearm.

2. The illuminated sighting system of claim 1, wherein the holder comprises one or more clips configured to retain the power source, and each of the one or more clips extending upwardly from the perimeter of the holder so as to contact at least a portion of a lateral side of the power source.

3. The illuminated sighting system of claim 1, wherein the holder is disposed atop a printed circuit board, and the light source comprises a light emitting diode which is mounted to the printed circuit board.

4. The illuminated sighting system of claim 2, wherein the one or more clips include a plurality of clips spaced along the perimeter of the holder.

5. The illuminated sighting system of claim 1, wherein the power circuit comprises a switch configured to maintain the power circuit when the firearm is in a first state and break the power circuit when the firearm is in a second state.

6. The illuminated sighting system of claim 5, wherein the power circuit does not include a manual on/off switch.

7. A method of modifying a firearm equipped with front and rear sights, comprising:

affixing a compartment to the firearm, the compartment housing a light source and conduit, the conduit configured to transmit light from the light source and provide an illuminated front sight of the firearm, assembling the compartment with a holder retaining a power source within an interior of the compartment, and providing a switch which completes a power circuit to effectuate supply of power from the power source to the light source when activated, wherein the compartment is a drop-in unit insertable in a portion of the firearm.

8. The method of claim 7, wherein the holder is attached to a printed circuit board, and the printed circuit board comprises a plurality of connection points for attachment to the compartment.

9. The method of claim 7, wherein the holder is configured to grip the power source via a plurality of clips on a perimeter of the holder, each of the clips extending upwardly from the perimeter of the holder so as to contact at least a portion of a lateral side of the power source.

10. The method of claim 7, wherein the power circuit does not include a manual on/off switch.

11. The method of claim 7, wherein the switch comprises a variable transducer configured to output a voltage that varies in accordance with proximity to a magnet.

12. The method of claim 7, further comprising inserting the drop-in unit into a top of the firearm, and covering the drop-in unit with a cover.

13. The method of claim 7, wherein a top of the firearm comprises a slide, and the drop-in unit is provided at an upper portion of the slide.

14. An illuminated sighting system for providing at least an illuminated front sight of a firearm comprising:

a compartment structured to secure a power source within the compartment;

a light source housed within the compartment in which the power source is secured or another compartment of the firearm;

a power circuit that provides power from the power source to the light source when activated; and a conduit configured to transmit light from the light source and provide at least an illuminated front sight of the firearm, the illumination generally directed at an operator of the firearm, wherein the compartment in which the power source is disposed is configured as a drop-in unit which is inserted in a top of the firearm.

15. The illuminated sighting system of claim 14, wherein the compartment is configured to mate with a portion of the top of the firearm.

16. The illuminated sighting system of claim 15, wherein the compartment is configured to mate with the portion of the top of the firearm via a stabilization member.

17. The illuminated sighting system of claim 15, wherein the compartment is covered by a cover attached to the top of the firearm.

18. The illuminated sighting system of claim 14, wherein the top of the firearm comprises a slide, and the drop-in unit is configured for insertion into an upper portion of the slide.

19. The illuminated sighting system of claim 1, wherein the drop-in unit is provided as a standalone unit, and an outer surface of the drop-in unit is exposed to an exterior.

20. The method of claim 7, wherein the drop-in unit is provided as a standalone unit, and an outer surface of the drop-in unit is exposed to an exterior.

* * * * *